US012618646B1

(12) United States Patent
Steenson, Jr. et al.

(10) Patent No.: US 12,618,646 B1
(45) Date of Patent: May 5, 2026

(54) VERIFICATION OF DESIRED TARGET ILLUMINATION IN THE PRESENCE OF CLUTTER FOR LASER-DESIGNATED APPLICATIONS

(71) Applicant: BAE Systems Information and Electronic Systems Integration Inc., Nashua, NH (US)

(72) Inventors: James H. Steenson, Jr., Hudson, NH (US); Connor Minguy, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 18/825,271

(22) Filed: Sep. 5, 2024

(51) Int. Cl.
*F41G 7/00* (2006.01)
*F41G 7/22* (2006.01)

(52) U.S. Cl.
CPC ..... *F41G 7/001* (2013.01); *F41G 7/226* (2013.01)

(58) Field of Classification Search
CPC ..... F41G 7/001; F41G 7/226; F41G 7/2266; F41G 7/2293
USPC ..... 235/400, 404, 411, 414; 244/3.16, 3.17
See application file for complete search history.

(56) References Cited

U.S. PATENT DOCUMENTS 8,054,451 B2 11/2011 Karazi et al.
8,653,427 B2 2/2014 Schmitt et al.
9,207,053 B2 12/2015 Ell et al.
9,383,170 B2 7/2016 Ell
9,857,145 B1 1/2018 Rutkiewicz et al.
9,915,504 B2 3/2018 Andorn et al.
10,055,648 B1 8/2018 Grigsby et al.
10,077,972 B1 9/2018 Choiniere et al.
10,126,101 B2 11/2018 Ell
10,203,414 B2 2/2019 Nazemi et al.
10,378,859 B2 8/2019 Evans
(Continued)

FOREIGN PATENT DOCUMENTS

EP 3296684 B1 8/2020
JP 2017040616 A * 2/2017
JP 2017156147 A * 9/2017

OTHER PUBLICATIONS

Machine translation of JP 2017156147 retrieved from European Patent Office on Oct. 28, 2025 (Year: 2025).*
(Continued)

*Primary Examiner* — Suezu Ellis
(74) *Attorney, Agent, or Firm* — Gary McFaline

(57) ABSTRACT

A laser seeker system is provided. The laser seeker system includes at least a laser pulse receiver circuitry and a pulse evaluator is provided. The pulse evaluator can be configured to obtain a set of measured pulse repetition intervals associated with laser pulses acquired by the laser pulse receiver circuitry. The pulse evaluator can further categorize a current volatility status indicating a respective category of a set of volatility categories, and based on a volatility index indicating a variance of the set of measured PRIs and a volatility counter indicating a number of the acquired laser pulses. The pulse evaluator can further increase a respective category counter that counts occurrences of the respective volatility category. The pulse evaluator can further categorize the authenticity of the laser seeker target based on the set of category counters.

22 Claims, 13 Drawing Sheets

(56) References Cited

U.S. PATENT DOCUMENTS

| | | | |
|---|---|---|---|
| 10,480,905 | B2 | 11/2019 | Sackett |
| 11,573,066 | B1 | 2/2023 | Streuber |
| 2015/0212201 | A1 | 7/2015 | Karazi et al. |

OTHER PUBLICATIONS

Machine translation of JP 2017040616 retrieved from European Patent Office on Oct. 28, 2025 (Year: 2025).*

* cited by examiner

VERIFICATION OF DESIRED TARGET ILLUMINATION IN THE PRESENCE OF CLUTTER FOR LASER-DESIGNATED APPLICATIONS

BACKGROUND

When a pulsed laser beam is used to designate, identify, or range-find a target or other object, reflections of the laser pulse off of the target can be detected by a laser pulse receiver, which may assign a relative or absolute time-of-arrival (TOA) of the pulse. The TOA may be related to the pulse's time-of-flight (TOF) from the laser pulse emitter to the target, and its return TOF to the receiver (the total laser path distance, or TLPD), at the speed of light through the medium(s) through which the pulse is traveling. An expected TOA of the next pulse can be determined if the firing interval between successive laser pulses is known, even if not at a consistent rate, and if changes in the TLPD can be assumed or anticipated. However, complicating factors can occur, which can result in laser pulse reflections being received from objects other than the intended target. Such reflections are referred to as "clutter" and can result from a laser pulse over-spilling or under-spilling, particulate suspended within the medium, and the like.

DETAILED DESCRIPTION

Figure 1:
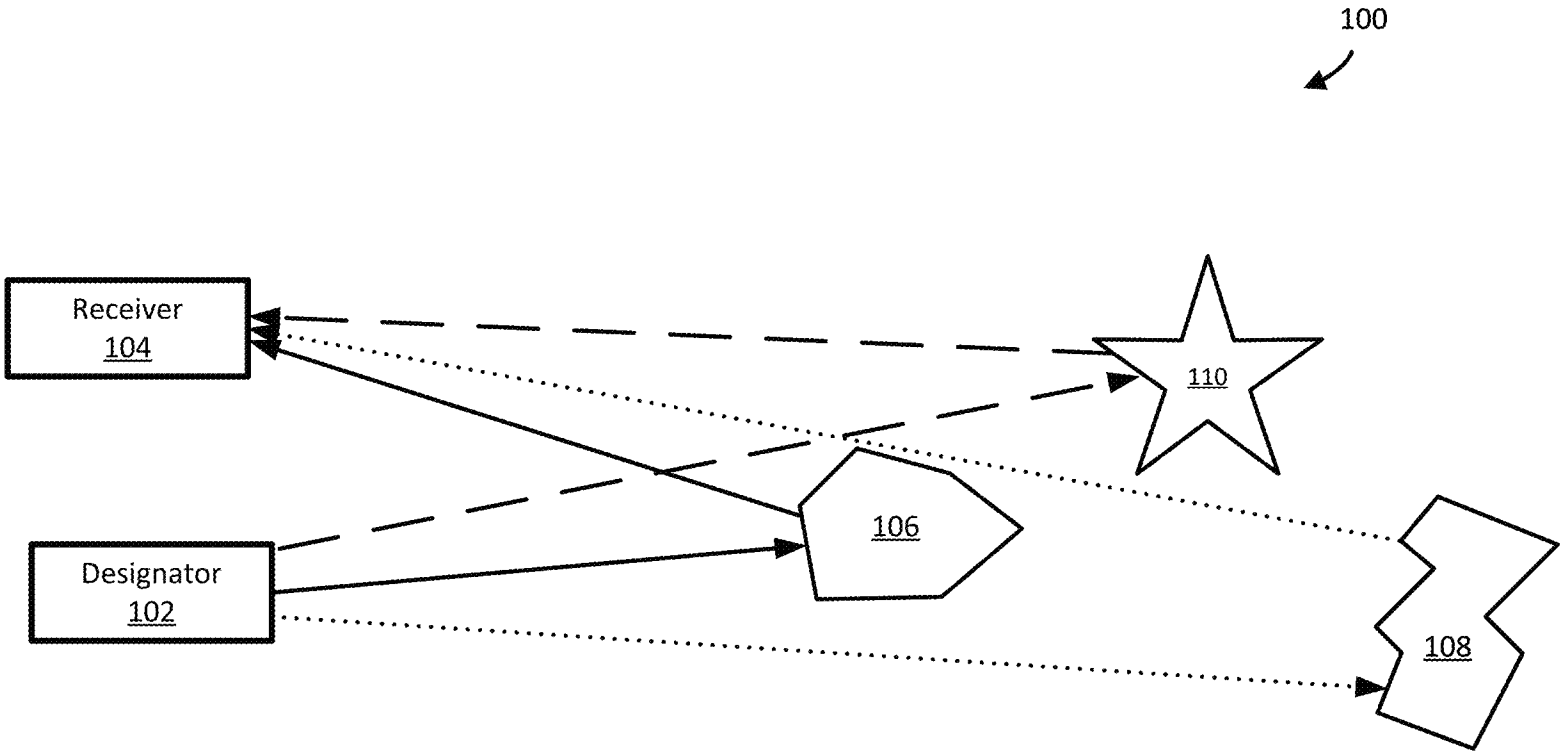
FIG. 1 schematically illustrates a laser seeker environment, including a laser designator configured to transmit laser pulses and a laser receiver configured to receive and process the pulses reflected from objects in the environment, in accordance with an example of the present disclosure.

Techniques are disclosed for categorizing authenticity of laser seeker targets. Example categories of authenticity may include, for instance, likely authentic, moderately likely to be authentic, and unlikely to be authentic. Other examples may include fewer or more such categories (e.g., highly likely to be authentic, and highly unlikely to be authentic, are two additional examples). An example scenario where the techniques may be helpful is the case where there are multiple objects (targets) within the field of view (FOV) of a laser seeker, with one of the objects being a true target (e.g., an adversarial drone or projectile) and the other objects being false targets (e.g., clutter). The laser seeker may be, for example, part of a projectile (e.g., laser guided missile) or a tracking system (e.g., unmanned aerial vehicle, or UAV), or a combination of these two, and is configured to illuminate objects within its FOV with laser light, which is in turn reflected back to the seeker. The laser seeker is further configured to analyze those reflections and discern the true target from false targets. A true target can be assigned, for instance, to the category of likely authentic or moderately likely to be authentic, and a false target can be assigned to the category of unlikely to be authentic. As a given engagement between the seeker and an object continues over time (allowing for collection of more reflections), the authenticity category assigned to that object can be updated and refined. The assigned authenticity category can then be used to inform mission planning, such as the example case where the laser seeker system can use the assigned authenticity category to make a determination as to whether or not to engage an object with a given asset (e.g., a munition). The laser seeker may, for example, issue a command to engage the laser seeker target, based on the laser seeker target categorized as being likely to be authentic; or issue a command to not engage the laser seeker target, based on the laser seeker target categorized as being unlikely to be authentic.

An example method includes obtaining a set of measured pulse repetition intervals (PRIs) associated with reflected laser pulses from one or more objects within a given FOV, and assigning a volatility status to those objects. The volatility status assigned corresponds to one of two or more authenticity categories (e.g., highly likely to be authentic, likely authentic, moderately likely to be authentic, unlikely to be authentic, and highly unlikely to be authentic). The process can be carried out for any object of interest within the FOV. The volatility status of a given object can be based, for instance, on a volatility index and a volatility counter. The volatility index indicates variance in the set of measured PRIs for a given object (e.g., clutter tends to produce PRI fluctuations or variance at a greater level than a true target), and the volatility counter indicates a number of acquired laser pulses from that object (e.g., the bigger the sample size, the better). Generally, a low PRI variability and a high number of acquired pulses tend to indicate likelihood of authenticity, whereas a high PRI variability and/or a low number of acquired pulses tend to indicate a low or otherwise lower likelihood of authenticity. For instance, in some such examples: an authenticity category of likely authentic corresponds to the volatility index being less than a low variance threshold value (low PRI variability) and the volatility counter being greater than a high count threshold value (high pulse count); an authenticity category of moderately likely to be authentic corresponds to the volatility index being between a high variance threshold value and the low variance threshold value (medium PRI variability) and the volatility counter being greater than the high count threshold value (high pulse count); and an authenticity category of unlikely to be authentic corresponds to the volatility index being greater than the high variance threshold value (high variability) and/or the volatility counter being below a low count threshold value (low pulse count). In some such examples, an authenticity category of highly likely authentic corresponds to the volatility index being less than the low variance threshold value for a relatively long period of time (persistent low PRI variability) and the volatility counter being greater than a high count threshold value (high pulse count), and an authenticity category of highly unlikely to be authentic corresponds to the volatility index being greater the high variance threshold value (and possibly persistently over a long period of time) and the volatility counter being greater than the high threshold value (high pulse count). In some examples, the method may further include increasing a category counter, to also track the number of times a given object has been assigned to a given authenticity category. Such a counter shows the persistence or maturity of an assigned authenticity category, which can further increase confidence of that assigned category. Once the authenticity of a given laser seeker target is determined (e.g., based on category counter), a further action may be carried out with respect to that target. Variations will be apparent in light of this description.

General Overview

As described above, when a pulsed laser beam is used to designate, identify, or range-find a target or other object, reflections of the laser pulse off of the target can be detected by a laser pulse receiver. However, complicating factors can occur, which can result in laser pulse reflections being received from objects other than the intended target. Such reflections are referred to as clutter, and can result from a laser pulse over- or under-spilling, particulate suspended within the medium, and the like. Lasing targets in a high clutter environment may result in acquisition of clutter rather than the desired target. In that case, there could be a risk of launching a rocket at an erroneous target, for example, without sufficient assurance or confidence that the laser is illuminating the correct target. Since the time-of-flight (TOF) from a reflective object depends on its total laser path distance (TLPD), the clutter's time-of-arrival (TOA) may differ slightly from that of the target, but the clutter's TOA will be temporally grouped within a certain window of time (which may be referred to as a gate) around the expected target TOA. Additionally, if the desired target and/or the clutter are moving, the clutter's TOA may change over time in a way that is inconsistent with the expected trend in the desired object's TOA. In general, objects will have the same TOA only if their TLPD is the same. When multiple closely-spaced reflected pulses arrive at the laser receiver's aperture, the receiver is often, but not necessarily, configured to select (or track) one of the pulses by some technique of discrimination, for further processing. For instance, the receiver may employ a discrimination method where it selects the last pulse received within a predetermined window of time (the "gate") around an expected TOA. This selection method is known as last pulse logic (LPL). If the selected pulse is from the desired or "authentic" or "true" or "expected" target, the TOA should be stable or change in a predictable manner. Conversely, if the selected pulses are from clutter, the TOAs of selected pulses will often vary in a manner which is inconsistent with expected variations in the desired object's TOA, as described above. Such inconsistency may also be referred to herein as volatility or unpredictability or instability (which may be used interchangeably herein), and is in distinct contrast to the non-volatile, predictable or stable TOA changes of the desired or true target.

To this end, techniques described herein can be used to exploit the temporal characteristics of a true target versus clutter, providing a number of advantages. First, an example system configured in accordance with an embodiment of the present disclosure can identify the TOA stability of a tracked object, and determine whether the TOA is more indicative of a desired target or of clutter, thereby verifying whether the tracked object is the desired target. In particular, the system can make use of the fact that TOAs from clutter are volatile, whereas TOAs from a true target are not volatile. Volatility refers to, for instance, an object's TOA unpredictability, including TOA variance that is inconsistent with respect to TOA variance of expected target. Second, such an example system can determine whether any changes observed in the tracked object are consistent with expected changes in the desired target's behavior. This can be accomplished using apriori knowledge of the desired target's behavior, or by direct comparison to the desired target's actual behavior if known or estimated by another method. Third, such an example system may replace a selection rule, such as LPL. Instead, the system can perform the signal processing technique on multiple pulses received in the gate, and use the results of those calculations to select the pulse for additional processing, regardless of its position within the gate.

Example Environment and System Architecture

FIG. 1 schematically illustrates a laser seeker environment 100, including a laser designator or transmitter 102 configured to transmit laser pulses, and a laser receiver 104 configured to receive and process the pulses reflected from objects in the environment, in accordance with an example of the present disclosure. In some examples, the laser transmitter 102 and laser receiver 104 are employed on a projectile or platform, such as a missile, rocket, mortar, or UAV. Although examples provided herein refer to airborne systems, the techniques may also benefit other tracking and/or targeting systems, such as ground-based systems and underwater systems (e.g., unmanned underwater vehicle, or UUV). After a target of interest has been identified, a laser designator (also referred to as a transmitter, emitter, or light source) is used to illuminate the target with a laser transmitter 102. The laser transmitter 102 flashes very short but powerful pulses of collimated light at a specific wavelength. The time interval between the light pulses is selectable from a previously established group of pulse repetition intervals (PRIs), so as to adhere to established accuracy and precision requirements, according to some examples. The collimated laser light or beam from the laser transmitter 102 tends to diverge slightly, such that the beam diameter increases over distance. At any given distance the beam has a particular diameter, which may vary based on the performance characteristics of the laser transmitter 102. As the light pulse travels through the medium (usually the atmosphere) portions of the pulse can encounter clutter 106 and 108, such as objects, terrain, atmospheric particulate, moisture, etc., as well as the intended target 110, all of which reflect the laser pulse. Some of the non-target reflectors 106 may be encountered prior to the target 110, while some 108 may be encountered beyond the target 110. The light reflected by objects 106, 108, and 110 can reflect a portion of the beam, and depending upon the surface shape, materials, and finish, reflect the light in different directions and with different spatial distributions. Some or all of those reflections may be received by a laser pulse receiver 104. The laser pulse receiver 104 can quantify and process the received pulses according to its design, and may be located within a platform navigating toward the intended target, such as a UAV, mortar, missile, guided rocket or projectile, or an aircraft. As used herein, aircraft includes fixed wing, rotary wing, UAV, and dirigibles. In other examples, the laser pulse receiver 104 may be at one location and convey target information to assets such as UUV, UAV, mortar, missile, guided rocket or projectile. In some examples, the laser designator 102 may be mounted on an aircraft, a ground vehicle, a ship, or be deployed by a person or autonomous platform.

Figure 2:
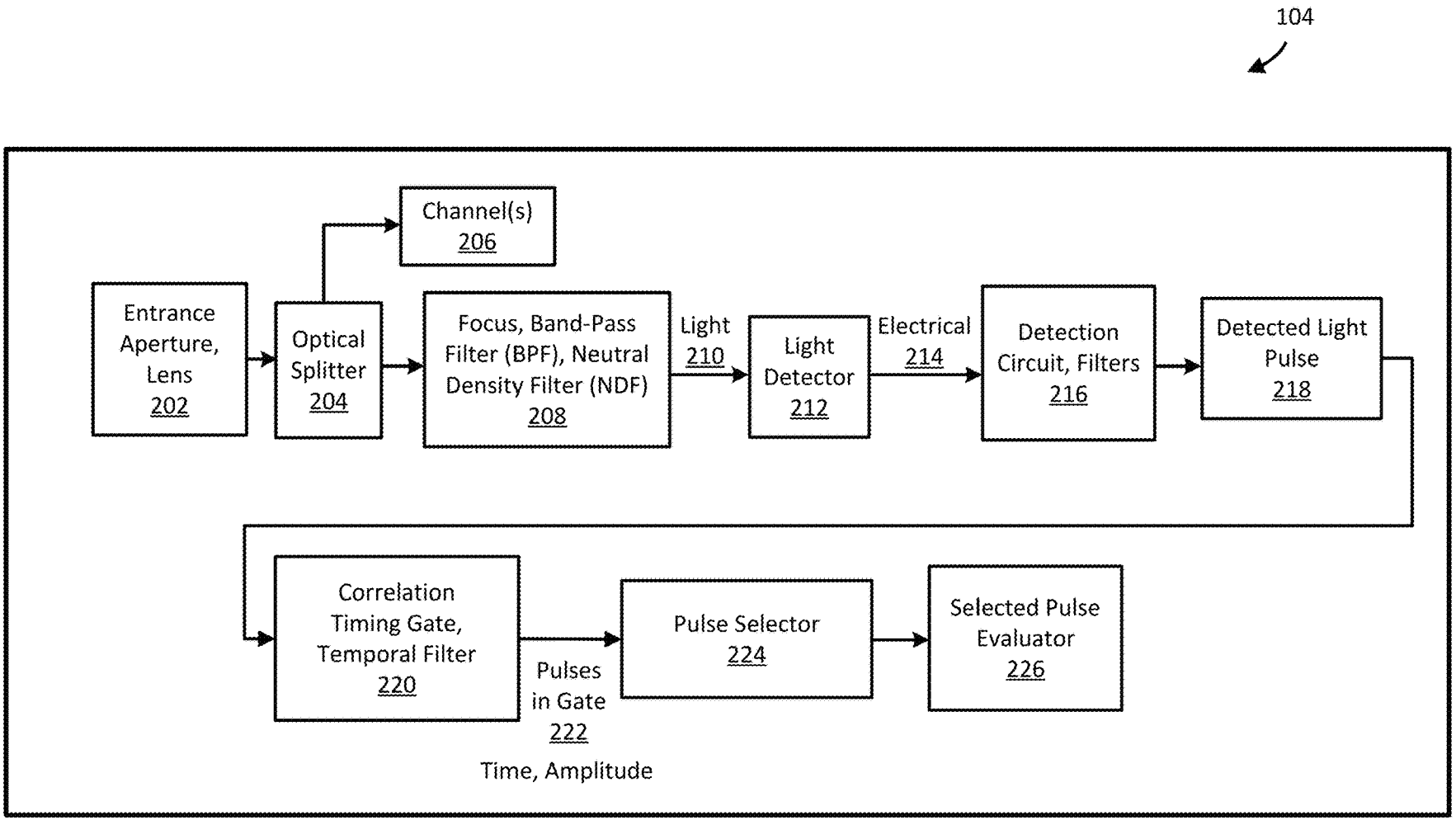
FIG. 2 is a block diagram illustrating components of a semi-active laser seeker, in accordance with an example of the present disclosure.

The laser pulse receiver 104 can receive the light pulses through a series of sensors, amplifier and filter circuitry, detection circuitry, and discretization circuitry, as in the example of FIG. 2. The laser pulse receiver 104 can determine that it is receiving the repetitive pulses associated with an expected PRI through a process referred to as correlation. Receiver 104 can then anticipate the arrival time of subsequent pulses, including a window around the expected arrival time, which may be referred to as a gate. Reflected light pulses from various reflectors 106-110 will arrive at different times within the gate because of different total path distances from Laser Transmitter 102 to Laser Pulse Receiver 104. The laser pulse receiver 104 then uses a selection process to determine which pulse within the gate should be considered for tracking the intended target. The selection process may use any of various selection criteria such as, but not limited to, the last pulse received within the gate (e.g., last pulse logic or LPL). Regardless of the method used to select the pulse for tracking, a pulse is selected and further processed. The processing may include the determination of direction to the target for purposes of navigating toward the target as previously discussed. If the selected pulse is however not that from the intended target, the navigation will be unreliable and result in a spurious flight which does not lead to the target.

When the object intended to be tracked (e.g., a target) is considered hostile, it may be necessary to determine whether to project force against the object. In such a situation, it is important to have high confidence that the laser pulse receiver (e.g., for a weapon system's targeting tracker) will be able to navigate to the target based on the pulses being selected.

Techniques described herein can evaluate the behavior of the selected pulses to determine if the laser pulse receiver 104 has correctly selected the signal from the target. In an example, techniques described herein may be used within the pulse selection process itself, giving the laser pulse receiver 104 the ability to select the true target pulse for further processing amid spurious pulses received from clutter 106 and 108. The system can evaluate the volatility of the selected PRI, and determine if the PRI behavior is that of an expected target. This technique can also be used to estimate the relative acceleration between the target and laser pulse receiver. Based on this evaluation, the system can achieve a high level of confidence that the object being tracked is the target.

If the system possesses information about the apparent PRI of a target as a function of the target's relative velocity (e.g., a relative velocity between the laser pulse receiver and target), techniques described herein can additionally determine the closing speed between the system and the target. If the system is stationary, this is equivalent to the closing speed of the target. In some embodiments, a negative closing speed signifies an approaching target, while a positive closing speed signifies the target is moving away from the system. This estimate may require a calibration shortly before use to overcome drift in the designator and the system's clocks. The more stable the clocks, the longer the system can operate between required calibrations. In some examples, the speed estimate has a resolution of approximately 1.5 m/s.

If the closing speed is known independently, for example from an independent detector such as radar or GPS, the agreement of these estimates can be used to further increase the confidence that the object being tracked is indeed the target. If the distance is known to an object with a TOA within the same timing gate, techniques described herein can additionally determine the distance to the target. If the distance is known independently, for example from an independent source of information such as radar or GPS, the agreement of these estimates can be used to further increase the confidence that the object being tracked is indeed the target.

FIG. 2 is a block diagram illustrating components of a receiver 104 of a semi-active laser seeker, in accordance with an example of the present disclosure. For example, the receiver 104 may provide additional detail of receiver 104 of FIG. 1.

In this example, the receiver 104 can include one or more lenses 202, an optical beam splitter 204, and a focus 208. For example, lenses 202 may provide an entrance aperture, where light reflected from the target and/or clutter sources may enter receiver 104. At the optical beam splitter 204, the light entering at the apertures 202 may be split, e.g., assigned to different channels, for example additional channel 206. In various examples, the receiver 104 may use different numbers of channels depending upon the angular resolution required in the field of view of the laser seeker 100. In some examples, if no angular resolution is needed, optical beam splitter 204 may not split the incident light. However, if angular information is required, beam splitter 204 may split or assign the light to different channels based on the light's direction of incidence.

Next, at focus 208, the light may be filtered. For example, the system can employ a neutral density filter (NDF) to reduce the level at all wavelengths. Alternatively or additionally, the system may employ a band-pass filter (BPF) to reduce the level at all wavelengths except a select area. In some filter topologies, the light should be parallel, or nearly so, in order for the filter to pass the correct wavelengths. In such a case, the system may also focus the light. In examples where the system employs multiple channels, such as additional channel 206, receiver 104 may include additional instances of focus 208, light detector 212, and detection circuit and filters 216 replicated for each channel and recombined in detection circuit and filters 216.

Light 210 emerging from focus 208 can enter light detector 212, where it can be converted to an electrical signal 214, for example via a photodiode. The electrical signal 214 can then pass through detection circuit 216, which may include filters.

For example, detection circuit 216 could include hardware, firmware, or a combination of hardware, firmware, and/or software, such as hardwired and/or programmable circuitry, computer processors, state machine circuitry, and/or gate level logic. In an example, the detection circuit 216 may include an analog to digital converter, digital low pass filter, digital high pass filter, scaling, and/or detection, which may be implemented as hardware and/or firmware. The detection circuit 216 may, collectively or individually, be embodied as circuitry that forms part of a larger system, for example, an integrated circuit (IC), an application-specific integrated circuit (ASIC), a system-on-a-chip (SoC), computers, and other processor-based or functional systems. Examples of hardware elements may include processors, microprocessors, circuits, circuit elements, integrated circuits, ASICs, programmable logic devices (PLD), digital signal processors (DSP), field programmable gate array (FPGA), logic gates, registers, semiconductor device, chips, microchips, chip sets, and the like.

Detection circuit 216 may detect a light pulse 218, which may pass through a correlation timing gate and temporal filter 220, to a pulse selector 224. In an example, detected light pulse 218 may be described by its numerical properties, such as its peak amplitude measured from each channel, and a relative time at which pulse 218 was received. In correlation timing gate and temporal filter 220, pulses such as pulse 218 may be processed to establish tracking (e.g., correlation), and the timing gate may provide a temporal filter of the pulses. In some examples, detection circuit 216 may be implemented as hardware and firmware.

In some examples, the timing gate 222 may hold multiple pulses. Accordingly, pulse selector 224 may select a pulse to use among the multiple acquired pulses. For example, as described in the example of FIG. 1, the pulse selector 224 can use a selection process to determine which pulse within timing gate 222 should be considered for tracking an intended target of the laser seeker. The pulse selector 224 may use any of various selection criteria such as, but not limited to, the last pulse received within the gate (e.g., last pulse logic or LPL), as in the example of FIG. 1. Accordingly, pulse selector 224 can select a pulse for tracking.

In some laser pulse detector systems, the processing of the acquired pulses may be completed after the pulse selector 224. However, the laser pulse receiver system 104 additionally includes a selected pulse evaluator 226, which can process multiple pulses to determine whether their behavior is more consistent with reflections from the desired target or from clutter, as disclosed herein.

Thus, the selected pulse can then pass to selected pulse evaluator 226, where it can be further processed. In one example, selected pulse evaluator 226 may determine a direction to the target, for the purpose of navigating toward the target. However, it is important that the selected pulse actually is reflected from the intended target. Otherwise, the navigation may become unreliable and result in a spurious flight that does not lead to the target. Accordingly, selected pulse evaluator 226 can evaluate the behavior of selected pulses, and can thereby categorize authenticity of the selected laser seeker target, as disclosed herein. For example, categorizing authenticity of the selected laser seeker target based on the behavior of the selected pulses is described in greater detail in the examples of FIGS. 4A-4C and 5A-5E below. A decision to engage (or not engage) the target can then be made based on the categorized authenticity of the selected laser seeker target. For instance, the laser pulse receiver system 104 may be configured to issue a command an asset to engage the target based on the categorized authenticity. In one such example case, the receiver system 104 may be onboard a UAV having one or more munitions, and the command could cause the UAV to engage the target with the one of the munitions, the target having a categorized authenticity that indicates that target is likely to be authentic. Alternatively, the issued command could be applied directly to the munition itself, so as to cause that munition to fire or launch, rather than applied indirectly through another system of the platform.

In various examples, selected pulse evaluator 226 may include software, hardware, firmware, and/or a combination of hardware and software, such as special purpose hardware, hardwired and/or programmable circuitry, computer processors, state machine circuitry, and/or gate level logic. Software may include a software package, code, instructions, instruction sets and/or data on a computer-readable storage device. Firmware may include code, instructions or instruction sets and/or data that are hard-coded (e.g., nonvolatile) in memory devices. The selected pulse evaluator 226 may, collectively or individually, be embodied as circuitry that forms part of a larger system, for example, an integrated circuit (IC), an application-specific integrated circuit (ASIC), a system-on-a-chip (SoC), computers, and other processor-based or functional systems. Examples of hardware elements may include processors, microprocessors, circuits, circuit elements (e.g., resistors, capacitors, diodes, transistors, and the like), integrated circuits, ASICs, programmable logic devices (PLD), digital signal processors (DSP), field programmable gate array (FPGA), logic gates, registers, semiconductor device, chips, microchips, chip sets, and the like. In one example, the selected pulse evaluator 226 may include one or more processors, and one or more memories encoded with instructions that when executed by the one or more processors cause functionality of the selected pulse evaluator (e.g., any of the methods of FIGS. 4A-C and 5A-E) to be carried out.

In some examples, the laser pulse receiver 104 can track the received signal, for example the selected pulse evaluator 226 and/or any other component of receiver 104 can track the received signal. In some examples, tracking the received signal may be performed either inside or outside the seeker. In some examples, the system tracks the signal as follows. First, the system can increase the seeker time, for example by incrementing the seeker time, and/or by calculating an increased seeker time. In an example, the system can increase the seeker time based on the seeker timestamp. Next, the system can calculate a raw PRI, for example by computing a difference between the last two seeker times. Next, the system can enable the PRI to handle missed pulses (e.g., by computing a modified or "special PRI", generally referred to herein as sPRI). In more detail, the system can compute the sPRI by estimating the average PRI over a whole number of PRI periods, thereby allowing for missed pulses. Otherwise, the system can set the sPRI to the raw PRI. Next, the system can convert the units of the sPRI to nanoseconds. Next, the system can update the acquisition counter. For example, the system may increment the acquisition counter if the pulse has been acquired, and otherwise decrement or set the acquisition counter between 0 and an expire value. Next, the system can update the volatility counter. For example, the system may increment the volatility counter if the pulse has been acquired, and otherwise decrement or set the volatility counter between 0 and an expire value. Next, the system can filter the sPRIs to be averaged, such that only sPRIs from acquired pulses are used in the average. Next, the system can calculate an average of the last 20 PRIs. Next, the system can calculate an average of the last 10 PRI averages. This average of averages may be used to develop the volatility index. Next, the system can calculate the volatility index. In some examples, the system calculates the volatility index based on a population-type variance numerator (e.g., a population variance based on 10 samples or any other number of samples), as disclosed herein. Next, the system can determine yellow status. Finally, the system can determine green status. In some examples, green status may supersede yellow. Accordingly, if both green and yellow are true, the system may select a green status. If neither yellow nor green are true, the system may select a red status.

Figure 3A:
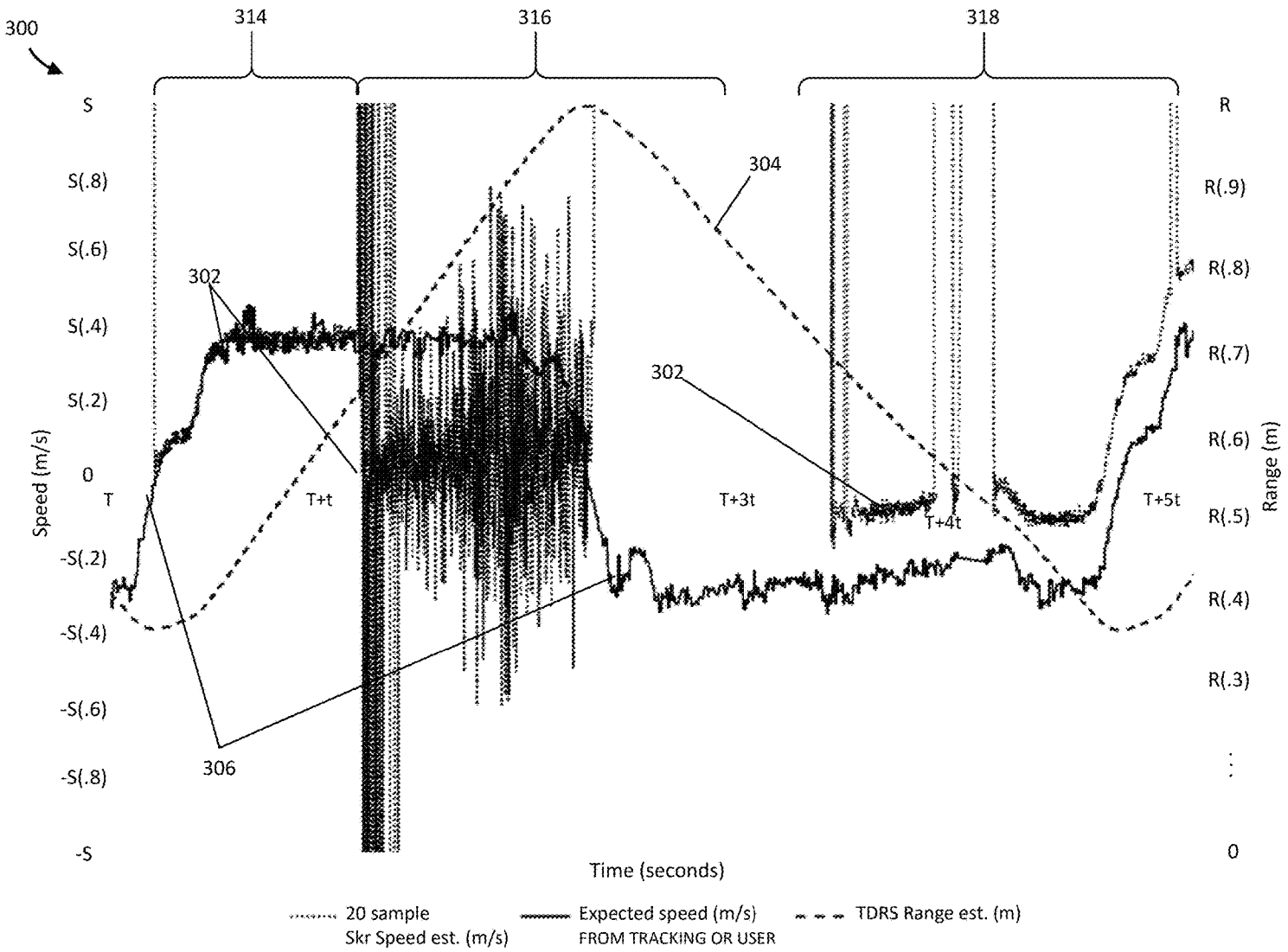
FIGS. 3A-3B illustrate results from example trials, in accordance with an example of the present disclosure.
Figure 3B:
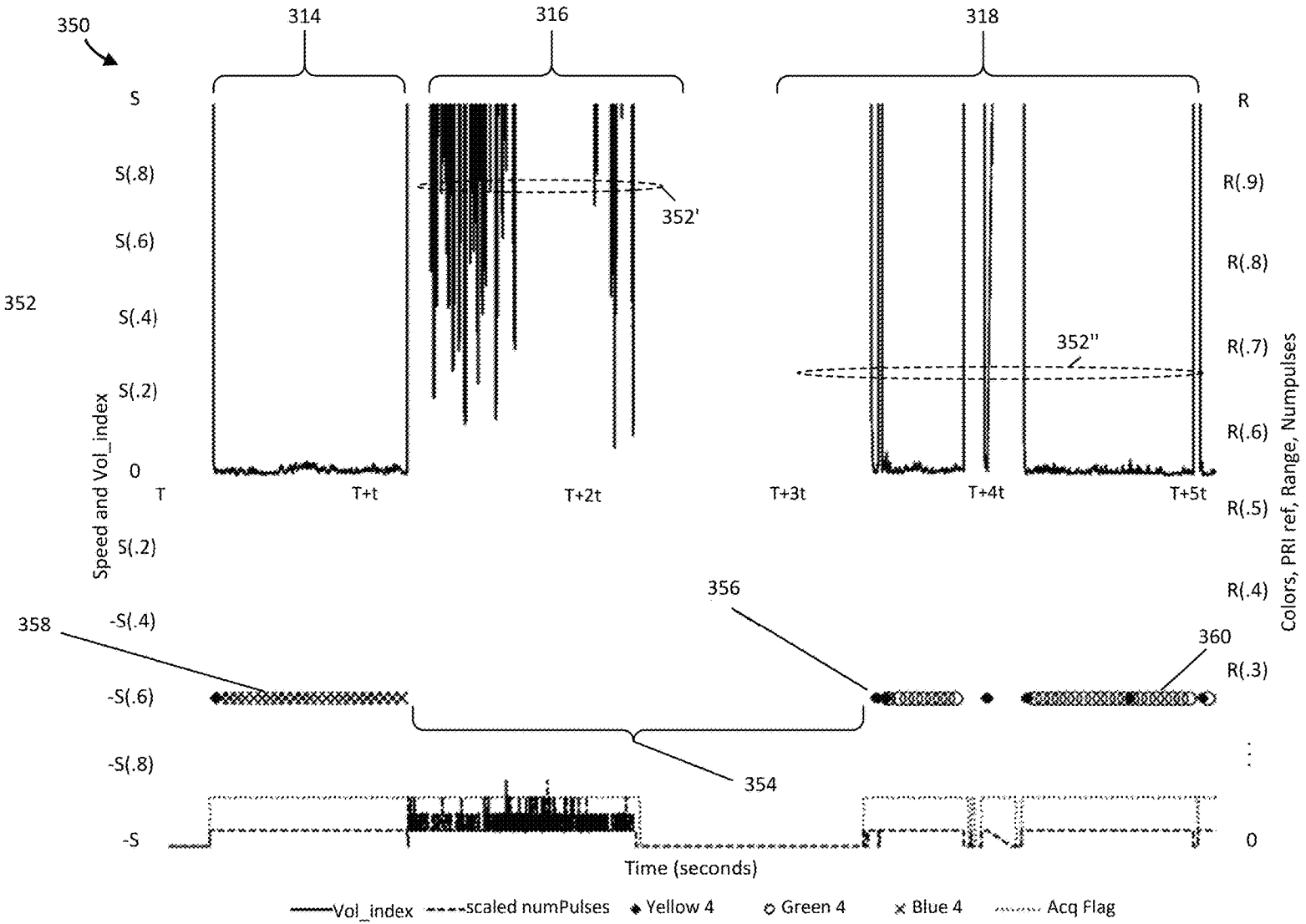

FIG. 3A illustrates results 300 from an example trial in accordance with an example of the present disclosure, and FIG. 3B illustrates results 350 from an example trial in accordance with an example of the present disclosure. Together, FIGS. 3A-B show, for example, how system 104 may use alternative sources to cross-check inferences made from the PRI analysis alone. With reference to example 300 of FIG. 3A, the curve 302 represents the receiver's closing speed estimate of the tracked object (e.g., a 20-sample seeker speed estimate). The curve 304 represents the actual slant range to the target. The curve 306 represents the desired target's actual closing speed, wherein the actual closing speed 306 may be based on an alternative estimate, e.g., an expected speed obtained from tracking, such as a GPS-or radar-based estimate, or from a user. The horizontal axis represents time in seconds (T, T+t, T_2t, . . . , T+5t, wherein T is an absolute time and t is an increment of time) from the start of the test data run. The left-hand vertical axis corresponds to the estimated closing speed 302 and actual closing speed 306 of the tracked object, in meters per second (m/s). Likewise, the right-hand vertical axis corresponds to the slant range 304 in meters (m). FIG. 3A is further described below, in conjunction with FIG. 3B.

The plotted curves of FIG. 3B include example volatility indexes 352, 352", 352", a PRI reference plot, a GPS based target range estimate, scaled number of pulses (e.g., numPulses), yellow flag 356, blue flag 358, green flag 360, and an acquisition flag for the pulses. The color flags (e.g., yellow 356, blue 358, and green 360) may be based on the PRI, the volatility of the PRI, and/or other counters, as variously described herein. For example, the absence 354 of a yellow flag 356, blue flag 358, or green flag 360 may correspond to a period of high volatility (e.g., an unstable PRI over 20 samples) indicated at 352". As shown, the horizontal axis represents time in seconds from the start of the test data run (e.g., seeker time). The left-hand vertical axis corresponds to the volatility index of the tracked object. Likewise, the right-hand vertical axis corresponds to color flags (e.g., yellow 356, blue 358, and green 360), PRI reference, range, and number of pulses.

In a first example 314, the receiver may track an object with low volatility index 352, so the system can determine that the tracked object is likely to be the desired object. In this example, the receiver's closing speed estimate 302 (FIG. 3A) of the tracked object may also match an alternative source 306 (FIG. 3A), such as a GPS- or radar-based estimate of the desired target's closing speed, thereby providing further confirmation that the tracked object is the desired object. In this example, the PRI may correspond to a blue flag 358. In this example, the blue flag represents the authenticity category that corresponds to the highest likelihood that the tracked object is a true target.

In a second example 316, the receiver may track an object with high volatility 352', so it is not the desired target. In this example, the color flag may be missing 354 due to the high volatility 352 of the PRI. Alternatively, a red flag may be used to represent the authenticity category that corresponds to a highest likelihood that the tracked object is not a true target.

In a third example 318, the receiver may track an object with low to medium volatility 352", so it is believed to be the desired object. In this example, the receiver's speed estimate 302 (FIG. 3A) has drifted, so the secondary confirmation 306 (FIG. 3A) does not agree with it. In particular, the shape of closing speed estimate 302 (FIG. 3A) does agree with alternative source 306 (FIG. 3A), but an offset is present. Nevertheless, on the basis of the low to medium volatility 352'", the system may accept the target as a true target. In this case, the PRI may correspond to a green flag 360. In this example, the green flag represents the authenticity category that corresponds to the second highest likelihood that the tracked object is a true target.

Said differently, 302 and 306 overlay extremely well (magnitude, offset and shape) in the left hand portion (314) of FIG. 3A and is an example of highly likely to be authentic. Then in the right hand portion (318) of FIGS. 3A, 302 and 306 have good magnitude and shape agreement but the offset has drifted (due to clock drift) and is an example of likely to be authentic.

Methodology

Figure 4A:
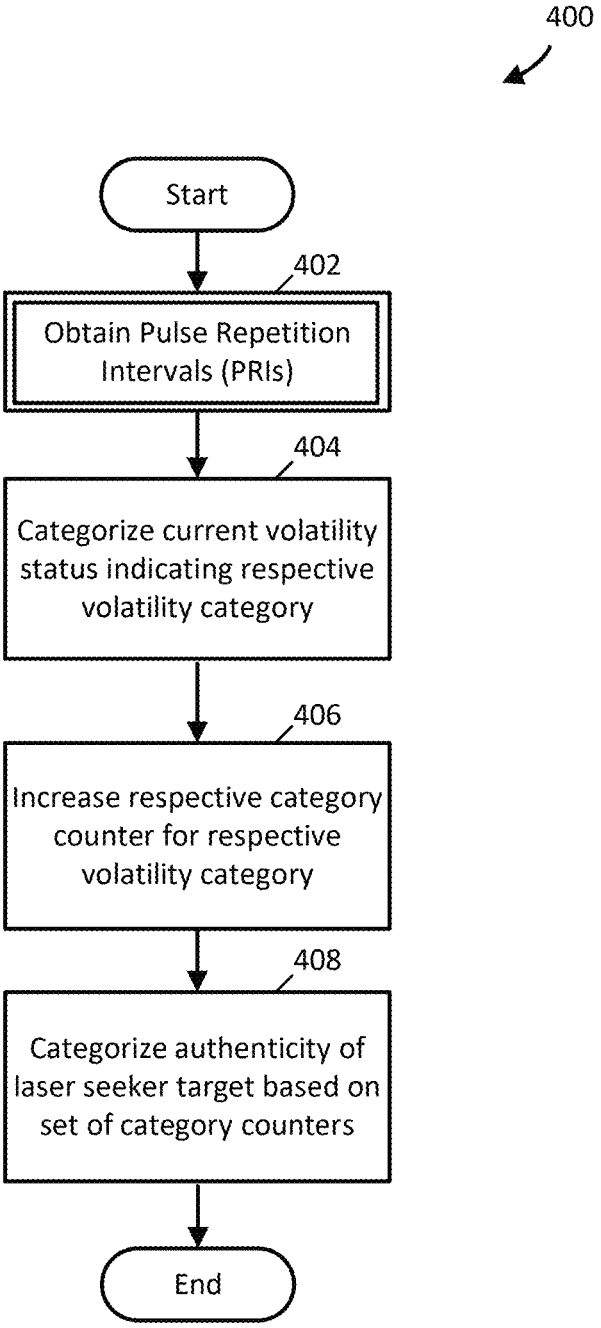
FIG. 4A is a flow diagram illustrating a method to categorize authenticity of a laser seeker target, in accordance with an example of the present disclosure.

FIG. 4A is a flow diagram illustrating a method 400 to categorize authenticity of a laser seeker target, in accordance with an example of the present disclosure. In various examples, method 400 may be performed by a laser seeker, laser seeker receiver (such as the receiver 104 of the example of FIG. 1), and/or a processor, FPGA, ASIC, or other circuitry. In some examples, a laser seeker system includes a selected pulse evaluator. In an example, the selected pulse evaluator may receive a selected laser pulse from a laser pulse selector, which may have been previously detected by a laser pulse detector by way of an entrance aperture (e.g., one or more lenses), as in the examples of FIGS. 1 and 2. The selected pulse evaluator may then perform the method 400 to categorize authenticity of a laser seeker target.

In some examples, the method 400 can be fully implemented using nested IF-THEN-ELSE and assignment statements. Moreover, the method may be implemented with addition, subtraction, multiplication, and division operations. Alternatively or additionally, the method may employ functions such as round ( ) average ( ) max ( ) min ( ) abs ( ) and square ( ) The method may store a number of PRI averages, for example the last 10 PRI averages, or some other number of PRI averages. In some examples, the method 400 may assume the tracking status RED whenever neither a YELLOW nor GREEN status has been asserted. In some examples, the method 400 may assume the tracking status GREEN when GREEN is asserted and BLUE is not. In some examples, the method 400 may assume the tracking status BLUE when BLUE is asserted. In some examples, GREEN status may supersede YELLOW. Accordingly, if both GREEN and YELLOW are true, the method may select a GREEN status. If neither YELLOW nor GREEN are true, the method may select a RED status.

As shown in FIG. 4A, the method to categorize target authenticity can start with the system obtaining 402 a set of measured pulse repetition intervals (PRIs) associated with acquired laser pulses.

In some examples, obtaining 402 the set of measured PRIs involves receiving a set of measured pulse time of arrival (TOA) values. The measured pulse TOA values can correspond to TOAs (for example, timestamps) of laser pulses reflected by the laser seeker's target (or by another object, such as clutter) and received by a laser pulse receiver or laser seeker receiver. Accordingly, the set of measured pulse TOA values can be received (e.g., by the selected pulse evaluator) from the laser pulse receiver or laser seeker receiver. In some examples, the set of measured PRIs comprises a time series of measured PRIs. Obtaining 402 the set of measured PRIs can further involve computing the PRIs as differences between pulse TOA values (e.g., successive pulse TOA values) of the set of measured pulse TOA values. In some examples, obtaining 402 the set of measured PRIs can further involve adjusting the pulse TOA values and/or the PRIs to correct for a seeker timer overflow.

Additional details of obtaining 402 a set of measured PRIs are described in the example of FIG. 5A below.

Next, the method to categorize target authenticity can continue with the system categorizing 404 a current volatility status of the laser seeker target. The current volatility status can indicate a respective volatility category of a set of volatility categories, and can be based on a volatility index and a volatility counter.

In some embodiments, the volatility index can based on the stability of the PRI over a number of sampled PRI values (e.g., 10 or 20 samples, or any other number of samples), for example the most recent PRI values. For example, the volatility index can indicate a variance in the set of measured PRIs, for example a population variance based on a number of samples, such as 10 or 20 samples. In some examples, the volatility index indicates a variance of a rolling average of the set of measured PRIs. For example, the volatility index may be computed as a variance of a rolling average of the 20 most recent PRI values. In an example, basing the volatility index on 20 samples provides roughly 0.5 nanosecond detection resolution. When tracking a reflective object with an inconsistently changing distance from the seeker, such as scatter, overspill, etc., the PRI may fluctuate. Accordingly, a stable PRI (reflected in a low variance in the set of PRIs, e.g. a low volatility index) can indicate a likely authentic target, whereas an unstable PRI (reflected in a high variance in the set of PRIs, e.g. a high volatility index) can indicate a likely inauthentic target.

The volatility counter may indicate a count of the acquired laser pulses.

For example, the current volatility status may indicate a currently determined likelihood that the laser seeker target is authentic. In this manner, the volatility status may be similar to a confidence level. In some examples, the system may update the current volatility status. For example, the system may categorize 404 a current volatility status for each respective PRI value (e.g., after updating a rolling average of the 10 or 20 most recent PRIs) based on the volatility index and volatility counter.

In some examples, the current volatility status may be a categorical variable, such as a categorical authenticity status. For example, the categorical status may be one of a plurality of categorical statuses indicating whether the laser seeker target is likely to be authentic. In some examples, the categories may be labeled by colors, such as red, yellow, green, and blue. For example, the plurality of categorical statuses may include a green status (e.g., indicating a likely authentic target), yellow status (a target that is moderately likely to be authentic), and red status (unlikely to be authentic). In some examples, the plurality of categorical statuses may also include a blue status (e.g., indicating that a green status has persisted for a threshold duration of time, the system's speed estimate falls within a specified tolerance, and the calibration is current).

In some examples, responsive to the volatility index being less than a first threshold value and the volatility counter being greater than a second threshold value, the current volatility status may denote a likely authentic target (e.g., a green status). In some examples, responsive to the volatility index being substantially between the first threshold value and a third threshold value and the volatility counter being greater than the second threshold value, wherein the third threshold value is greater than the first threshold value, the current volatility status may denote a target that is moderately likely to be authentic (e.g., a yellow status). In some examples, responsive to the volatility index being at least the third threshold value or the volatility counter being at most the second threshold value, the current volatility status may denote a target that is unlikely to be authentic (e.g., a red status). Categorizing 404 the current volatility status will be described in greater detail in the examples of FIGS. 5A-5E below.

In some examples, the system may also generate other indices and/or signals. For example, the system can optionally generate a "fuel gauge" signal, such as a variable signal that may aid in fine adjustment of the laser spot positioning. For example, the system may rescale the signal into a so-called viable signal, and may then compute the fuel gauge signal as a rolling average of the viable signal (e.g., over 20 time steps, or any other number of time steps or samples). If the rolling average exceeds a ceiling threshold value, the system may instead determine the fuel gauge signal as the ceiling threshold value. In some examples, the system may only determine the fuel gauge signal if the current volatility and/or authenticity status is green, otherwise the fuel gauge signal may be an empty or not-a-number (NaN) value. In some cases, range to target and environmental factors may also affect the signal quality, thus in some embodiments the fuel gauge signal may require additional processing.

Next, the method to categorize target authenticity can continue with the system increasing 406 a counter for the current volatility status. For example, the system may maintain (e.g., store in non-transitory memory or storage) a separate counter for each categorical status, such as a green counter, yellow counter, and red counter. In some examples, once the current volatility status has been categorized, the system may increment 406 the respective counter corresponding to the categorical authenticity status. For example, responsive to categorizing the respective status as yellow, the system may increment the yellow counter by one unit.

In some examples, the system may update 406 one or more counters in other ways. For example, the system may decrement or otherwise decrease a counter, such as decrementing the yellow or green counters, as described in the examples of FIGS. 5D and 5E.

Increasing or otherwise updating 406 the counters will be described in greater detail in the examples of FIGS. 5A-5E below.

Next, the method to categorize target authenticity can continue with the system categorizing 408 the authenticity of the laser seeker target based on the set of category counters updated in operation 406, and/or on any combination of the plurality of counters the system maintains for each categorical status.

In some examples, the current volatility status set in operation 404 indicates a currently determined likelihood that the laser seeker target is authentic (for example, a variance of a rolling average of the set of measured PRIs), whereas the authenticity determined in operation 408 may indicate a cumulative likelihood that the laser seeker target is authentic. In some examples, the current volatility status of operation 404 may be referred to as a tentative or "searching" verification status. In some examples, the target authenticity of operation 408 may be referred to as an "acquired" verification status.

For example, the system may compare the counter for a respective categorical status (e.g., based on tentative or "searching" statuses determined in operation 404) to a corresponding threshold before determining 408 an "acquired" verification status. In some examples, the thresholds may be referred to as yellow_dur, green_dur, and blue_dur for yellow, green, and blue statuses, respectively. For example, a "yellow acquired" verification status may be determined 408 responsive to a yellow counter greater than a threshold yellow_dur, and a "green acquired" verification status may be determined 408 responsive to a green counter greater than a threshold green_dur, as described in the examples of FIGS. 5D and 5E below.

In some examples, the method 400 can categorize a plurality of current volatility statuses of the laser seeker target. For example, the set of measured PRIs may be a time series, and the system may obtain an updated set of measured PRIs, and may then update the current volatility status and/or the categorization of the authenticity.

In some examples, the operations 402, 404, and/or 406 may be repeated for each PRI received and/or each current volatility status categorized. For example, the method 400 can further include obtaining an updated set of measured PRIs. For example, the current volatility status of the laser seeker target can be a first current volatility status of the laser seeker target, and the counter associated with the current volatility status can be a first counter. The method can further include categorizing a second volatility status of the laser seeker target based at least on an updated volatility index for the updated set of measured PRIs. The method can further include increasing a second counter associated with the second volatility status of the laser seeker target. In some examples, the method can further include updating the categorization of the authenticity based on the increased first counter or the increased second counter. Accordingly, the categorization of the authenticity of operation 408 can be a cumulative categorization based on part or all of the set of measured PRIs (e.g., based on the updated time series of PRIs). In some examples, the method 400 further includes decreasing the respective category counter counting occurrences of the respective volatility category.

The method 400 can then end.

Figure 4B:
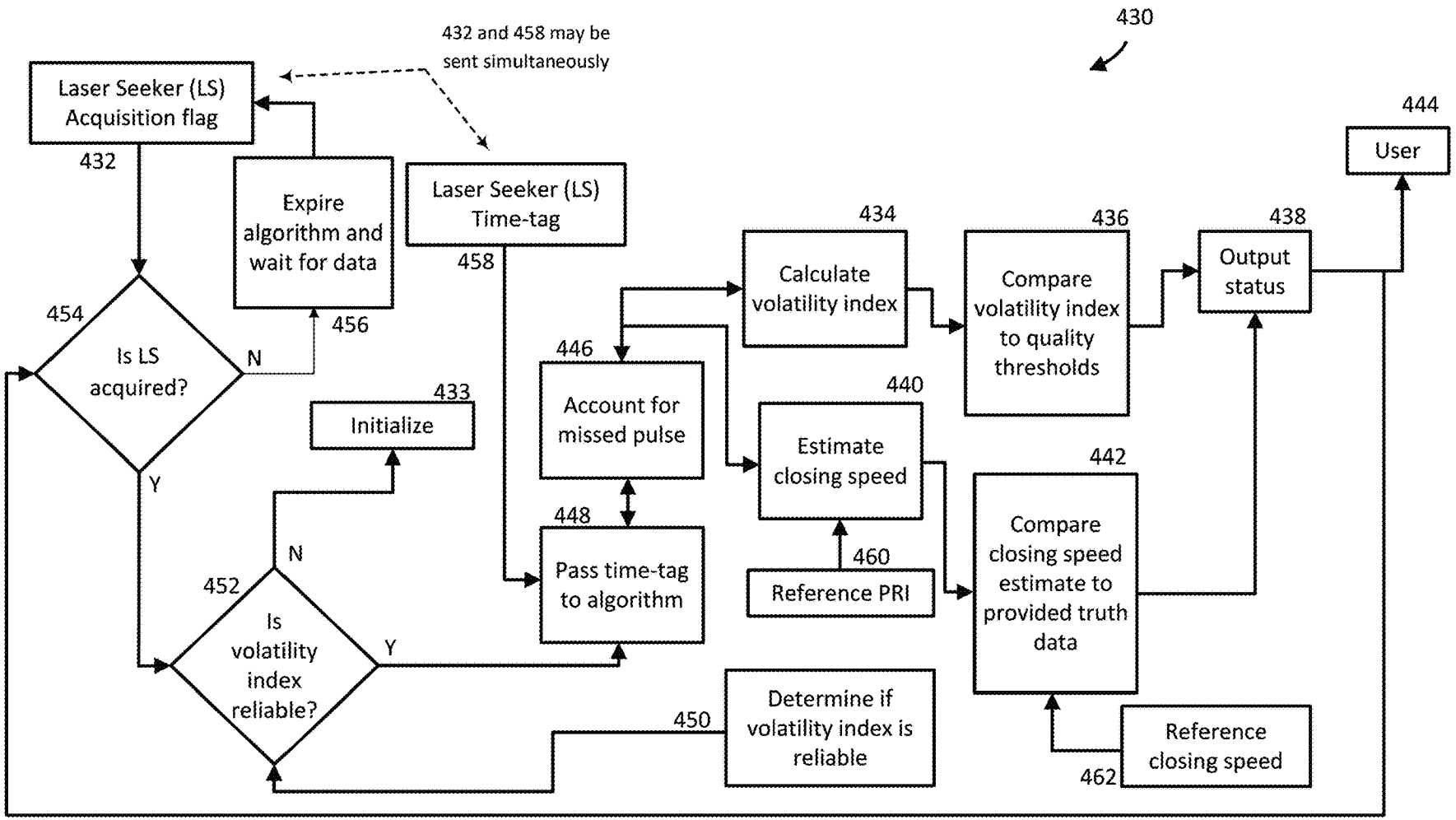
FIG. 4B is a flow diagram illustrating a method to categorize authenticity of a laser seeker target, in accordance with an example of the present disclosure.

FIG. 4B is a flow diagram illustrating a method 430 to categorize authenticity of a laser seeker target, in accordance with an example of the present disclosure.

In operation 432, the laser seeker (LS) can send an acquisition flag. In some examples, the seeker sends acquisition flag 432 and time tag 458 (e.g., a pulse timestamp) simultaneously. In operation 454, the system can determine whether the pulse has been acquired (e.g., by the LS). Such determination can be based on the acquisition flag set at 432 (e.g., flag=0 for not acquired; flag=1 for acquired).

In operation 456, the system can expire the algorithm and wait for data.

In operations 450 and 452, the system can determine whether the volatility index of operation 434 is reliable. Reliability of the volatility index is a measure that can vary by application based on how noisy the given process is. In some example cases, such reliability is based on the recent history of pulse reception, but such reliability can also be set empirically. In any such case, the purpose of the volatility stability check is to determine if the pulse acquisition process is stable enough to make sound volatility decisions. Initially the check may call for a higher level of persistent acquisition, but in the event of a brief loss of acquisition after having previously established reliability, the stability check may allow reliability to be re-established with a lower level of persistence. The various one or more thresholds used to assess reliability can be determined empirically based on given data sets, although other examples may use different thresholds.

In one such example, there are three thresholds related to the reliability: T1, T2, and T3. Threshold T1 may be set based on a number of reliable PRI delays (e.g., T1=Reliable_PRI_delay, may be set, for instance, to 5 or some other threshold suitable for the given application). Threshold T2 may be set based on the number of volatility calculations (e.g., T2=Begin_vol_calc, which may be set, for instance, to 15 or some other threshold suitable for the given application). Threshold T3 represents the number of noise messages to expire a previously established volatility benefit (e.g., T3=Noise messages to expire previous volatility benefit, which may be set, for instance, to 10 or some other threshold suitable for the given application). One such example reliability check may be carried out as follows.

The volatility counter is initialized at 0, and the volatility counter increments by one with each consecutive pulse after the laser seeker declares that a target is acquired. Once the volatility counter reaches threshold T1, the methodology begins calculating PRIs. When the volatility counter reaches a value of T2 or greater, the methodology includes asserting or declaring that reliable PRI volatility measurements have been established. When/if the laser seeker loses acquisition, the volatility counter will be set to T3-1 (e.g., so 9 in this example case) if it had reached a value greater than T3. For each non-acquired message then received, the counter is decremented by one until reaching zero. For losses of acquisition that last more than T3-1 (e.g., 9) non-acquired messages, thus the counter reaches zero, the full burden of persistent acquisition is required to re-establish reliability. For losses of acquisition that are brief enough that the volatility counter does not reach zero, reliability can be re-established by counting back up to T2. For example, if the volatility counter had reached any number greater than T3 and acquisition is lost, the counter is immediately set to T3-1 (e.g., 9). If two non-acquired messages are then received, the volatility counter will decrement to 7. If the target is again acquired, the volatility counter will begin incrementing and need only count from 7 back to T2 (e.g., 15) in order to re-establish reliability. As indicated above, other examples may use a different thresholding scheme to assess reliability of volatility index.

In operation 433, the system can initialize in response to a determination that the volatility index of operation 434 is not reliable.

In operation 458, the laser seeker (LS) can obtain a time tag (e.g., a pulse timestamp).

In operation 448, the system can pass the time tag to the algorithm.

In operation 446, the system can account for any missed pulses.

In operation 434, the system can calculate a volatility index. When tracking a reflective object with an inconsistently changing distance from the seeker, such as scatter, overspill, etc., the PRI may fluctuate. Accordingly, in some embodiments, the volatility index can based on the stability of the PRI over a number of sampled PRI values (e.g., 10 or 20 samples, or any other number of samples), for example the most recent PRI values. For example, the volatility index can indicate a variance of a rolling average of the set of measured PRIs over a number of samples. In some examples, a stable PRI (reflected in a low variance in the set of PRIs, e.g. a low volatility index) can indicate a likely authentic target, whereas an unstable PRI (reflected in a high variance in the set of PRIs, e.g. a high volatility index) can indicate a likely inauthentic target.

In operation 436, the system can compare the volatility index to quality thresholds. In operation 438, the system can output the status for the user 444.

In operation 440, the system can estimate the closing speed of the target. For example, the system can obtain a reference pulse repetition interval (PRI) value 460, and can use the reference PRI value 460 to estimate 440 the closing speed of the target.

In some examples, the system estimates a relative closing speed between itself and the target (e.g., between the laser pulse receiver and target). If the system is stationary, this is equivalent to the closing speed of the target. In some embodiments, a negative value of the closing speed estimate signifies an approaching target, while a positive value signifies the target is moving away from the system. This estimate may require a calibration shortly before use to overcome drift in the designator and the system's clocks. The more stable the clocks, the longer the system can operate between required calibrations. In some examples, the speed estimate has a resolution of approximately 1.5 m/s.

In some examples, the system estimates the closing speed as follows. First, the system can calculate averages of the last 20 and 40 PRIs. In an example, the system may calculate these averages based on a modified or special PRI (generally referred to as sPRI). In more detail, and as described above, the sPRI can account for missed pulses, for example, by providing a value to represent missed pulses, wherein the provided value is an estimated average PRI over the missed pulse period. In some examples, the sPRI is only determined if the pulse has been acquired (e.g., by the LS). Next, the system may optionally lase a stationary target, wait for the green tracking indicator, wait an additional delay period (e.g., 2 seconds), then pulse a signal to set the reference PRI (e.g., a set_refPRI signal). In some examples, the reference PRI (e.g., refPRI) can be a PRI value captured while acquired on a stationary target. In some examples, lasing the stationary target, waiting, and pulsing the signal to set the reference PRI may be an optional or recommended operation, and/or may be performed as soon as practically possible prior to estimating the speed. Next, the system may update the reference PRI; in some examples, the system may wait for a delay period (e.g., at least 2 seconds) after green or blue tracking status before updating the reference PRI. Finally, the system may calculate the estimated target speed relative to the system (e.g., a relative velocity or speed between the laser pulse receiver and target) in m/s. Negative values may indicate the target is approaching the system, while positive values may indicate the target is moving away from the system.

In some examples, the system can also perform a speed match test. In more detail, a speed match test may use an expected slant speed of the target acquired from an independent source, such as radar, GPS, or a tracking system. In some such examples, the system may perform the speed match test with an update rate of 1 second or better. According to some examples, the system performs the speed match test as follows. First, the system can determine a speed error, e.g. a discrepancy between the system's closing speed estimate, as described above, and the expected target speed from the independent source. Next, the system can determine if the speed error is below the threshold. Next, the system may update the reference PRI (e.g., refPRI) time. For instance, in some examples, the system may update the reference PRI whenever the reference PRI is reset for the speed estimate. For example, the system may wait at least 2 seconds after green or blue tracking status before updating the reference PRI. Finally, the system can determine blue status. In some examples, blue status may supersede green. Accordingly, if both blue and green are true, the method may select a blue status. If neither yellow nor green are true, the method may select a red status.

In operation 442, the system can compare the closing speed estimate to the provided truth data. For example, the system can obtain a reference closing speed value 462, and can compare 442 the closing speed estimate to the reference closing speed value 462.

Figure 4C:
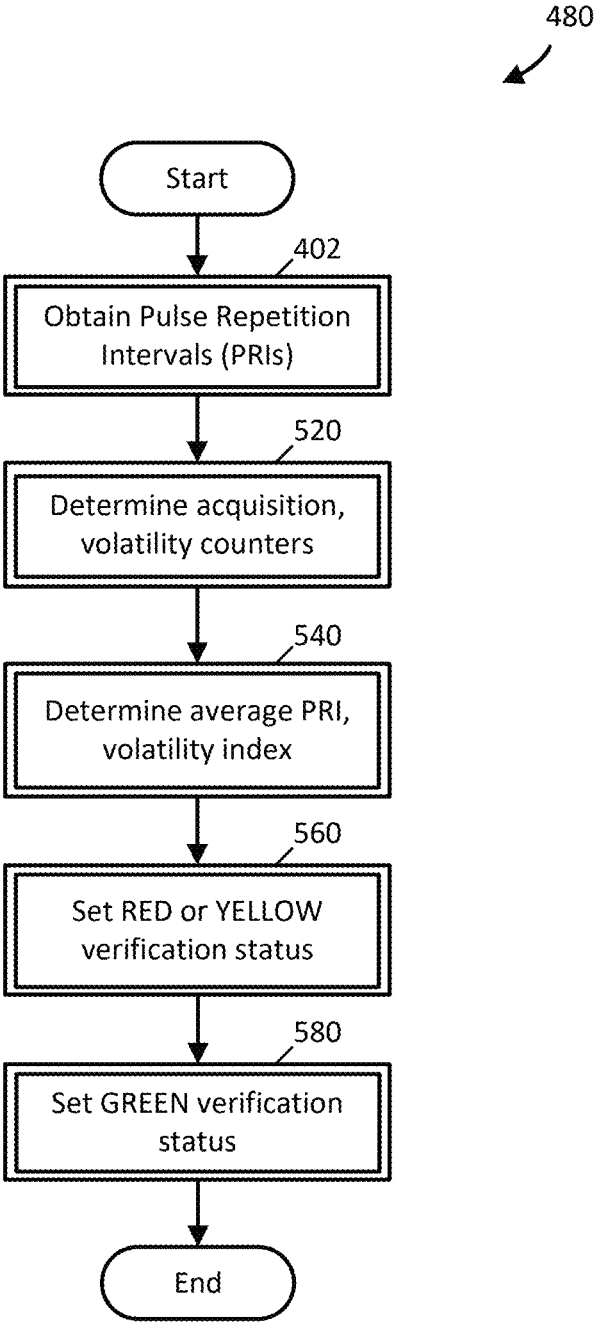
FIG. 4C is a flow diagram illustrating a method to categorize authenticity of a laser seeker target, in accordance with an example of the present disclosure.

FIG. 4C is a flow diagram illustrating a method 480 to categorize authenticity of a laser seeker target, in accordance with an example of the present disclosure. In various examples, method 480 may be performed by a laser seeker, laser seeker receiver (such as the receiver 104 of the example of FIG. 1), and/or a processor, FPGA, ASIC, or other circuitry.

As shown in FIG. 4C, the method to categorize target authenticity can start with the system obtaining 402 a set of measured pulse repetition intervals (PRIs) associated with acquired laser pulses.

As in the example of FIG. 4A, obtaining 402 the set of measured PRIs may involve receiving a set of measured TOA values. Obtaining 402 the set of measured PRIs can further involve computing the PRIs as differences between pulse TOA values (e.g., successive pulse TOA values). In some examples, obtaining 402 the set of measured PRIs may further involve adjusting the pulse TOA values and/or the PRIs to correct for a seeker timer overflow.

Additional details of obtaining 402 a set of measured PRIs are described in the example of FIG. 5A below.

Next, the method to categorize target authenticity can continue with the system determining 520 acquisition and volatility counters. For example, if the laser pulse has been acquired by the seeker, the system can increment the acquisition and volatility counters. If the pulse has not been acquired, the system can decrement or otherwise reduce the acquisition and volatility counters. Additional details of determining 520 acquisition and volatility counters are described in the example of FIG. 5B below.

Next, the method to categorize target authenticity can continue with the system determining 540 an average PRI and volatility index. For example, if the acquisition counter (also referred to as an acquire counter) exceeds a threshold value (e.g., 5 or 10, some other suitable threshold), the system can calculate the average value of a PRI circular buffer. If the acquire counter does not exceed the threshold value, the system can push a value of zero into the PRI circular buffer. If the volatility counter exceeds a threshold value, the system can calculate the volatility index. If the volatility counter does not exceed the threshold value, the system can set the volatility index to a large value.

When tracking a reflective object with an inconsistently changing distance from the seeker, such as scatter, overspill, or the like, the PRI may fluctuate. Accordingly, the volatility index may be based on the stability of the PRI over a number of sampled PRI values. For example, the volatility index can indicate a variance of a rolling average of the set of PRIs over a number of samples (e.g., 10 or 20 samples, or any other number of samples). In some examples, a stable PRI indicates a likely authentic target, whereas an unstable PRI indicates a likely inauthentic target.

Additional details of determining 540 an average PRI and volatility index are described in the example of FIG. 5C below.

In some examples, the system may also generate other indices and/or signals. For example, the system can optionally generate a "fuel gauge" signal, such as a variable signal that may aid in fine adjustment of the laser spot positioning. In some examples, the fuel gauge signal may be based on the signal strength, and be on when the volatility status and/or authenticity status is green or better. For example, the system may rescale the signal into a so-called viable signal, and may then compute the fuel gauge signal as a rolling average of the viable signal (e.g., over 20 time steps, or any other number of time steps or samples). If the rolling average exceeds a ceiling threshold value, the system may instead determine the fuel gauge signal as the ceiling threshold value. In some examples, the system may only determine the fuel gauge signal if the current volatility and/or authenticity status is green, otherwise the fuel gauge signal may be an empty or not-a-number (NaN) value. In some cases, range to target and environmental factors may also affect the signal quality, thus in some embodiments the fuel gauge signal may require additional processing.

Next, the method to categorize target authenticity can continue with the system setting 560 red or yellow verification status. For example, if the volatility index is less than a threshold value, and the volatility counter exceeds a second threshold value, the system can increment a yellow counter. If the yellow counter exceeds a third threshold value, the system can set a yellow status. Otherwise, the system may set a red status. Additional details of setting 560 a red or yellow verification status are described in the example of FIG. 5D below.

Next, the method to categorize target authenticity can continue with the system setting 580 a green verification status. For example, if the volatility index is less than a threshold value, and the volatility counter exceeds a second threshold value, the system can increment a green counter. If the green counter exceeds a third threshold value, the system can set a green status. Additional details of setting 580 the green verification status are described in the example of FIG. 5E below.

The method 480 can then end.

FIGS. 5A-5E are flow diagrams illustrating details of a method to categorize authenticity of a laser seeker target, in accordance with an example of the present disclosure.

Figure 5A:
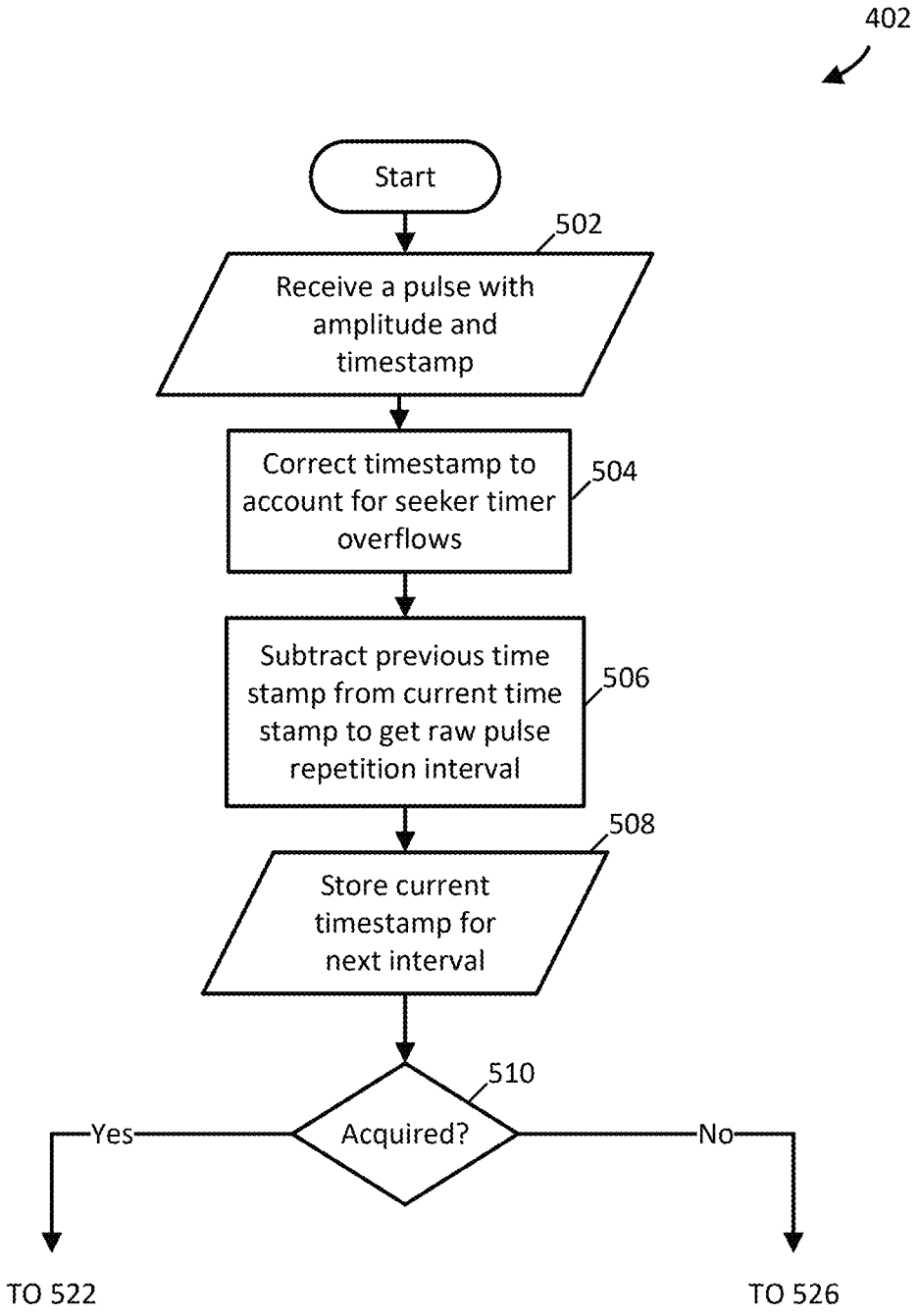
FIGS. 5A-5E are flow diagrams illustrating details of a method to categorize authenticity of a laser seeker target, in accordance with an example of the present disclosure.

FIG. 5A is a flow diagram illustrating details of a method 402 to obtain a set of measured PRIs associated with acquired laser pulses while categorizing authenticity of a laser seeker target, in accordance with an example of the present disclosure. In various examples, method 402 may be performed by a laser seeker, laser seeker receiver (such as the receiver 104 of the example of FIG. 1), and/or a processor, FPGA, ASIC, or other circuitry.

As shown in FIG. 5A, the method to obtain a set of measured PRIs associated with acquired laser pulses can start with the system receiving 502 a pulse with an amplitude and a timestamp.

Next, the system can correct 504 the timestamp to account for seeker timer overflows. For example, the seeker time may be stored in a 32-bit counter. If the counter overflows, an error in the calculated time difference (e.g., delta time) could result. Accordingly, the system can detect when the overflow occurs and correct it by adding the 32-bit max value before calculating the time difference.

Next, the system can subtract 506 previous time stamp from current time stamp to get raw pulse repetition interval (PRI) associated with the newly received pulse.

Next, the system can store 508 the current timestamp for the next interval.

Next, the system can determine 510 whether the pulse has been acquired. Responsive to the pulse being acquired, the system can proceed with operation 522 of FIG. 5B. Responsive to the pulse not being acquired, the system can proceed with operation 526 of FIG. 5B.

Figure 5B:
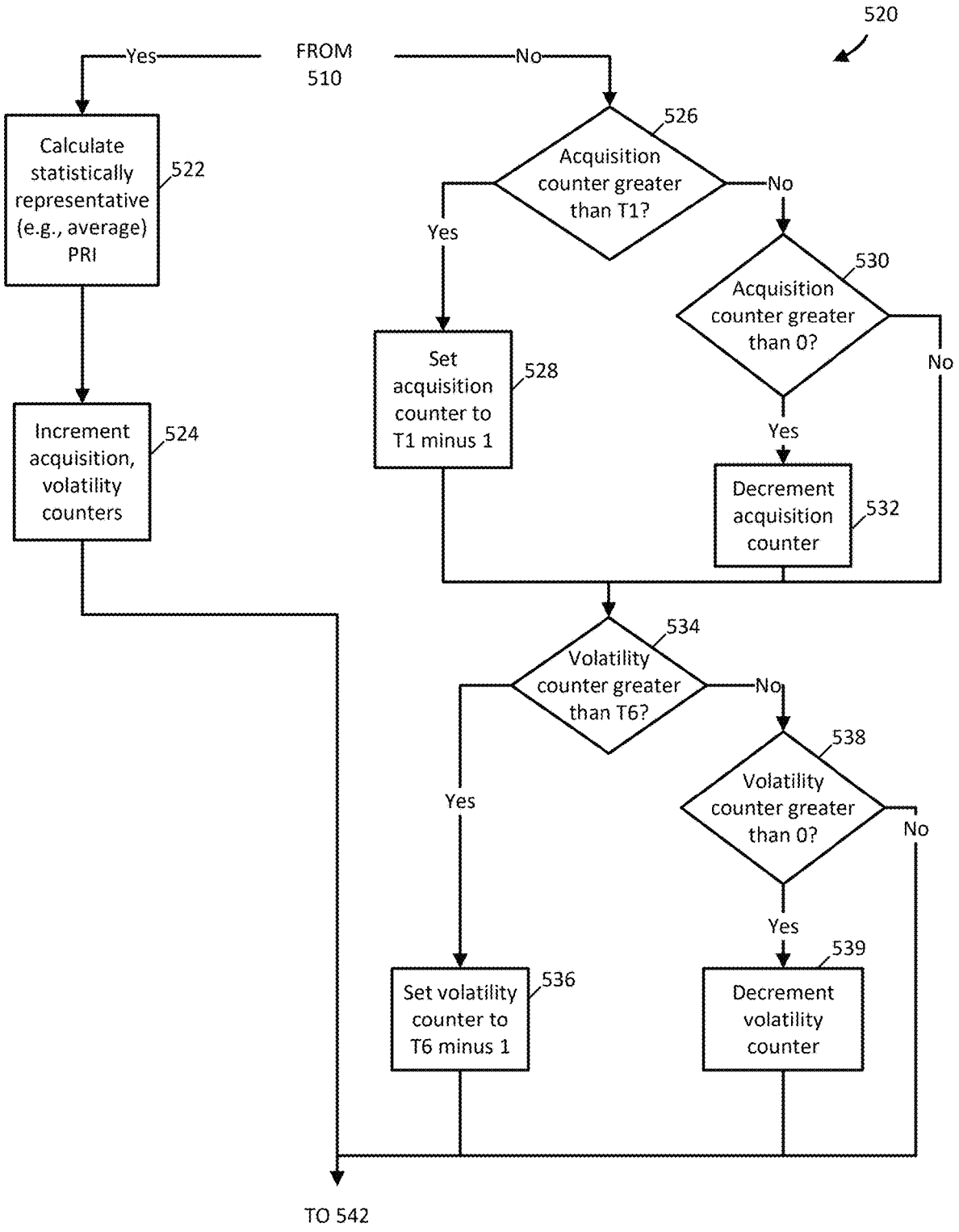

FIG. 5B is a flow diagram illustrating details of a method 520 to determine acquisition and volatility counters while categorizing authenticity of a laser seeker target, in accordance with an example of the present disclosure.

As shown in FIG. 5B, responsive to the pulse being acquired, the method to determine acquisition and volatility counters while categorizing authenticity of a laser seeker target can start with the system calculating 522 a special PRI (sPRI, or estimated average PRI).

Next, the system can increment 524 the acquisition and volatility counters. The system can then proceed with operation 542 of FIG. 5C. Example thresholds (e.g., counter thresholds and volatility index thresholds) are given at determination blocks as further described below. A given threshold may be set, for instance, to ensure a statistically meaningful data set has been acquired. Depending on the system and demands thereof, a given threshold can be set relatively low or relatively high.

Responsive to the pulse not being acquired, the method to determine acquisition and volatility counters while categorizing authenticity of a laser seeker target can start with the system determining 526 whether the acquisition counter is greater than threshold T1. Threshold T1 is used to establish a minimum number of acquired laser pulses such that the PRI is considered stable. Value is application dependent but could range, for instance, from 2 to 20, according to some examples.

Responsive to the acquisition counter being greater than threshold T1, the system can then set 528 the acquisition counter to threshold T1 minus 1. The system can then proceed with operation 534.

Responsive to the acquisition counter not being greater than threshold T1, the system can then determine 530 whether the acquisition counter is greater than 0. Responsive to the acquisition counter being greater than 0, the system can decrement the acquisition counter, and then proceed with operation 534. Responsive to the acquisition counter not being greater than 0, the system can proceed directly to operation 534.

The system can then determine 534 whether the volatility counter is greater than Threshold 6. Threshold 6 is used to establish a minimum number of acquired laser pulses such that the volatility calculations are considered stable. Value is application dependent but could range, for instance, from 5 to 30, according to some examples.

Responsive to the volatility counter being greater than threshold 6, the system can then set 536 the volatility counter to threshold 6 minus 1. The system can then proceed with operation 542 of FIG. 5C.

Responsive to the volatility counter not being greater than threshold 6, the system can then determine 538 whether the volatility counter is greater than 0. Responsive to the volatility counter being greater than 0, the system can decrement the volatility counter, and then proceed to operation 542 of FIG. 5C. Responsive to the volatility counter not being greater than 0, the system can proceed directly to operation 542 of FIG. 5C.

Figure 5C:
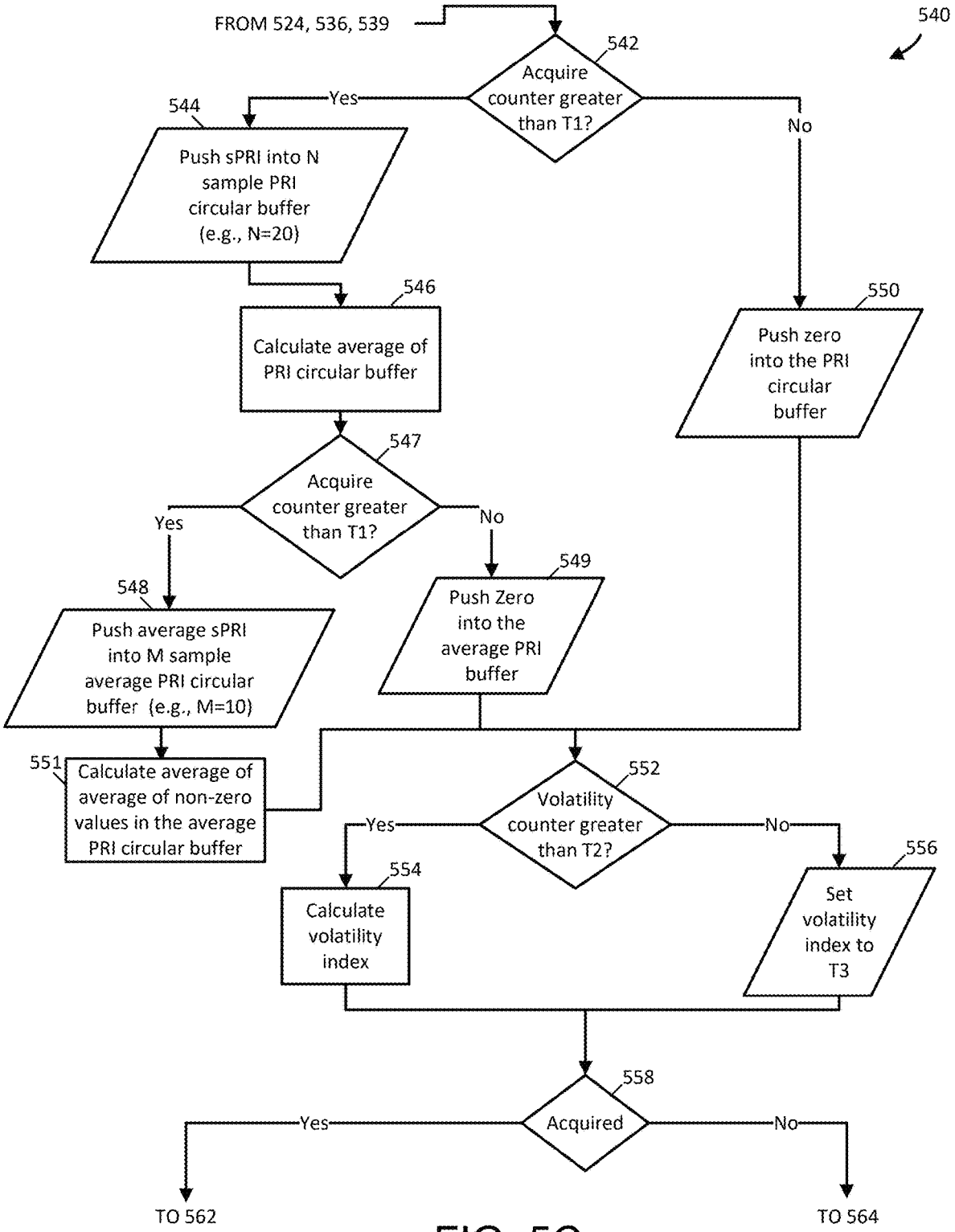

FIG. 5C is a flow diagram illustrating details of a method 540 to determine an average PRI and volatility index while categorizing authenticity of a laser seeker target, in accordance with an example of the present disclosure.

As shown in FIG. 5A, the method to determine an average PRI and volatility index while categorizing authenticity of a laser seeker target can start with the system determining 542 whether the acquire counter is greater than threshold 1.

Responsive to the acquire counter being greater than threshold 1 in operation 542, the system can then push 544 the special PRI (sPRI) into an N sample PRI circular buffer. The system can then calculate 546 the sliding average of the N sample PRI circular buffer. For instance, in one such example, the sliding average of the PRI circular buffer is the average of the N sPRI values in the PRI circular buffer at that particular time (e.g., N=20, or other appropriate buffer size). The system can again determine 547 whether the acquire counter is greater than threshold 1. Responsive to the acquire counter still being greater than threshold 1, the system can then push 548 the average sPRI into an M sample average PRI circular buffer. The system can then calculate 551 the sliding average of the M samples average PRI circular buffer. For instance, in one such example, the sliding average of the average PRI circular buffer is the average of the non-zero M values in the average PRI circular buffer at that particular time (e.g., N=10, or other appropriate buffer size). The system can proceed with operation 552. Responsive to the acquire counter no longer being greater than threshold 1, the system can then push 549 zero into the average PRI circular buffer, and can proceed to operation 552.

Responsive to the acquire counter not being greater than threshold 1 in operation 542, the system can push 550 zero into the PRI circular buffer, and then proceed to operation 552.

The system can then determine 552 whether the volatility counter is greater than threshold 2. Threshold 2 is used to establish a minimum number of acquired laser pulses such that the volatility calculations are considered stable. Value is application dependent but could range, for instance, from 5 to 30, according to some examples.

Responsive to the volatility counter being greater than threshold 2, the system can then calculate 554 the volatility index, and then proceed to operation 558.

Responsive to the volatility counter not being greater than threshold 2, the system can then set 556 the volatility index to threshold 3, and proceed to operation 558. Threshold 3 establishes a high volatility ceiling that is relatively much greater than volatility indices of interest, yet allows quick acknowledgement of improvement when an authentic target is encountered. Value is application dependent but could be, for instance, 10× to 1000× any volatility index of interest, according to some embodiments.

Next, the system can determine 558 whether the pulse has been acquired. Responsive to the pulse being acquired, the system can proceed with operation 562 of FIG. 5D. Responsive to the pulse not being acquired, the system can proceed with operation 564 of FIG. 5D.

Figure 5D:
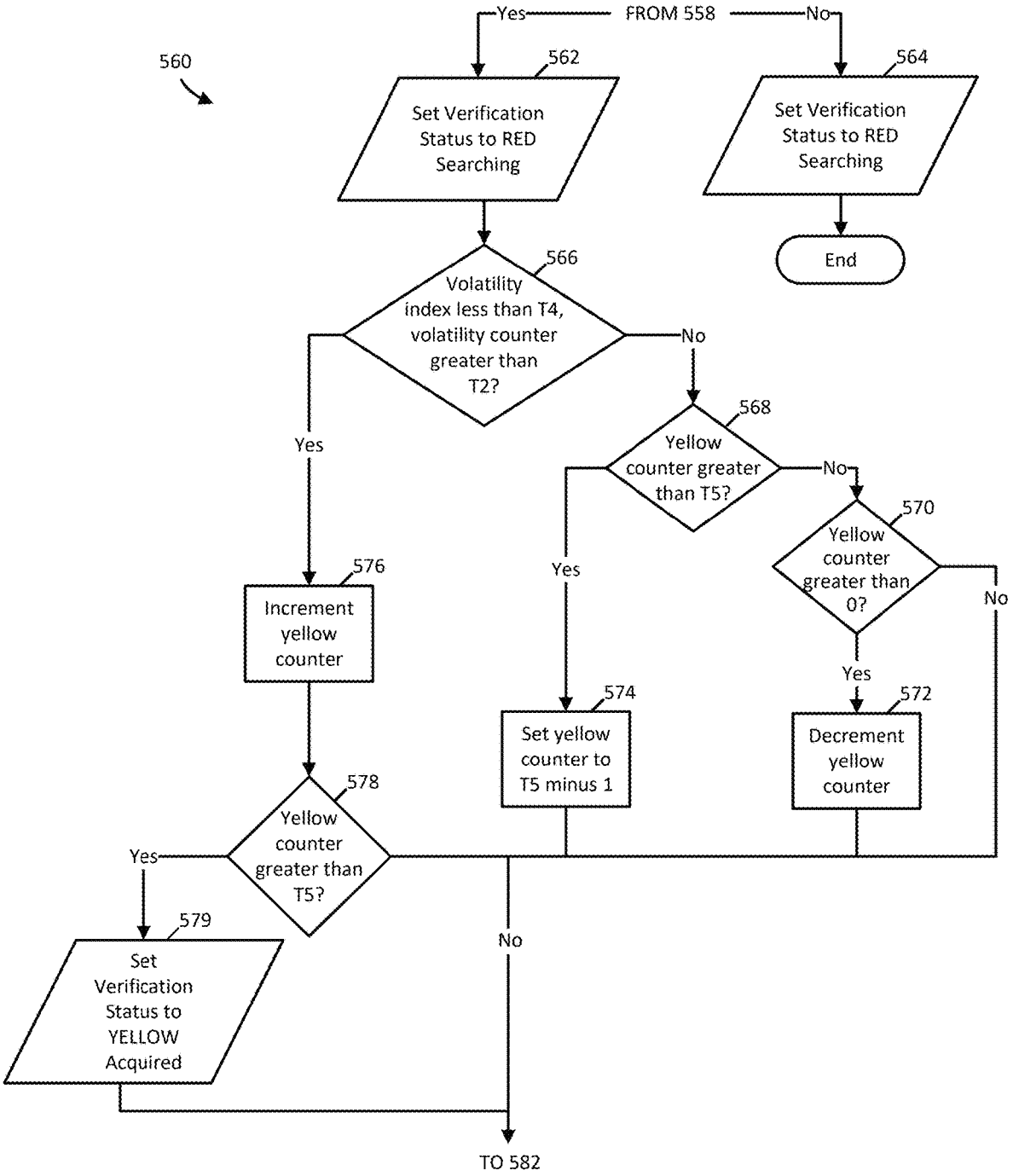

FIG. 5D is a flow diagram illustrating details of a method 560 to set red or yellow verification status while categorizing authenticity of a laser seeker target, in accordance with an example of the present disclosure.

As shown in FIG. 5D, responsive to the pulse not being acquired, the method to set red or yellow verification status while categorizing authenticity of a laser seeker target can start with the system setting 564 the verification status to "RED Searching." The method can then end.

Responsive to the pulse being acquired, the method to set red or yellow verification status while categorizing authenticity of a laser seeker target can start with the system setting 562 the verification status to "RED Searching."

Next, the system can determine 566 whether the volatility index is less than threshold T4 and the volatility counter is greater than threshold T2. Threshold T4 is used to establish a volatility value associated with those pulses who are moderately likely to be authentic. Value is application dependent but could range, for instance, from 5 to 50, according to some embodiments. Threshold T2 is as previously described above.

Responsive to the volatility index not being less than threshold T4 or the volatility counter not being greater than threshold T2 in operation 566, the system can then determine 568 whether the yellow counter is greater than threshold T5. Threshold T5 is used to establish a minimum number of volatility calculations that are consistently below Threshold 4. Value is application dependent but could range, for instance, from 5 to 30, according to some examples.

Responsive to the yellow counter being greater than threshold T5, the system can then set 574 the yellow counter to a value below threshold T5 (e.g., it can set 574 the yellow counter to threshold T5 minus 1), and can then proceed with operation 582 of FIG. 5E.

Responsive to the yellow counter not being greater than threshold T5, the system can then determine 570 whether the yellow counter is greater than 0. Responsive to the yellow counter being greater than 0, the system can decrement 572 the yellow counter, and can then proceed with operation 582 of FIG. 5E. Responsive to the yellow counter not being greater than 0, the system may proceed directly to operation 582 of FIG. 5E.

Responsive to the volatility index being less than threshold T4 and the volatility counter being greater than threshold T2 in operation 566, the system can then increment 576 the yellow counter.

Next, the system can determine 578 whether the yellow counter is greater than threshold T5. Responsive to the yellow counter being greater than threshold T5 in operation 578, the system can set 579 the verification status to "YELLOW Acquired," and can then proceed with operation 582 of FIG. 5E. Responsive to the yellow counter not being greater than threshold T5 in operation 578, the system can then proceed to operation 582 of FIG. 5E.

Figure 5E:
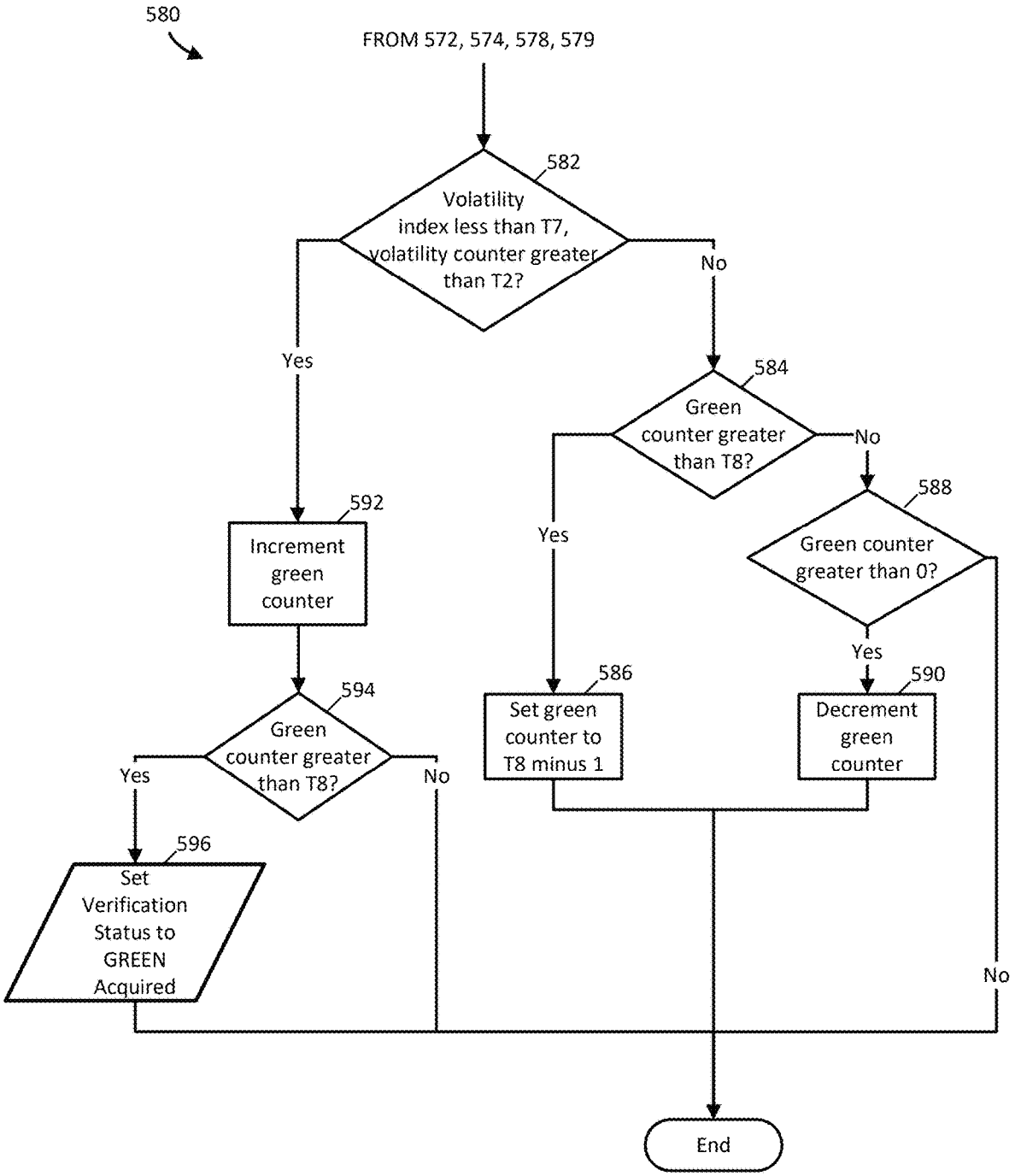

FIG. 5E is a flow diagram illustrating details of a method 580 to set a green verification status while categorizing authenticity of a laser seeker target, in accordance with an example of the present disclosure.

As shown in FIG. 5E, the method to set a green verification status while categorizing authenticity of a laser seeker target can start with the system determining 582 whether the volatility index is less than threshold T7 and the volatility counter is greater than threshold T2. Threshold 7 is used to establish a volatility value associated with those pulses who are likely to be authentic. Value is application dependent but could range from, for instance, 1 to 5. Threshold 2 is as previously above described.

Responsive to the volatility index being less than threshold T7 and the volatility counter being greater than threshold T2, the system can then increment 592 the green counter.

Next, the system can determine 594 whether the green counter is greater than threshold T8. Threshold 8 is used to establish a minimum number of volatility calculations that are consistently below Threshold 7. Value is application dependent but could range from, for instance, 5 to 30, according to some examples. Responsive to the green counter being greater than threshold T8 in operation 594, the system can set 596 the verification status to "GREEN Acquired." The method 580 can then end.

Responsive to the green counter not being greater than threshold T8 in operation 594, the method 580 can then end.

Responsive to the volatility index not being less than threshold T7 or the volatility counter not being greater than threshold T2 in operation 582, the system can then determine 584 whether the green counter is greater than threshold T8.

Responsive to the green counter being greater than threshold T8 in operation 584, the system can then set 586 the green counter to threshold T8 minus 1. The method 580 can then end.

Responsive to the green counter not being greater than threshold T8 in operation 584, the system can then determine 588 whether the green counter is greater than 0. Responsive to the green counter being greater than 0 in operation 588, the system can decrement 590 the green counter. Responsive to the green counter not being greater than 0 in operation 588, the system may take no action.

The method 580 can then end.

Figure 6:
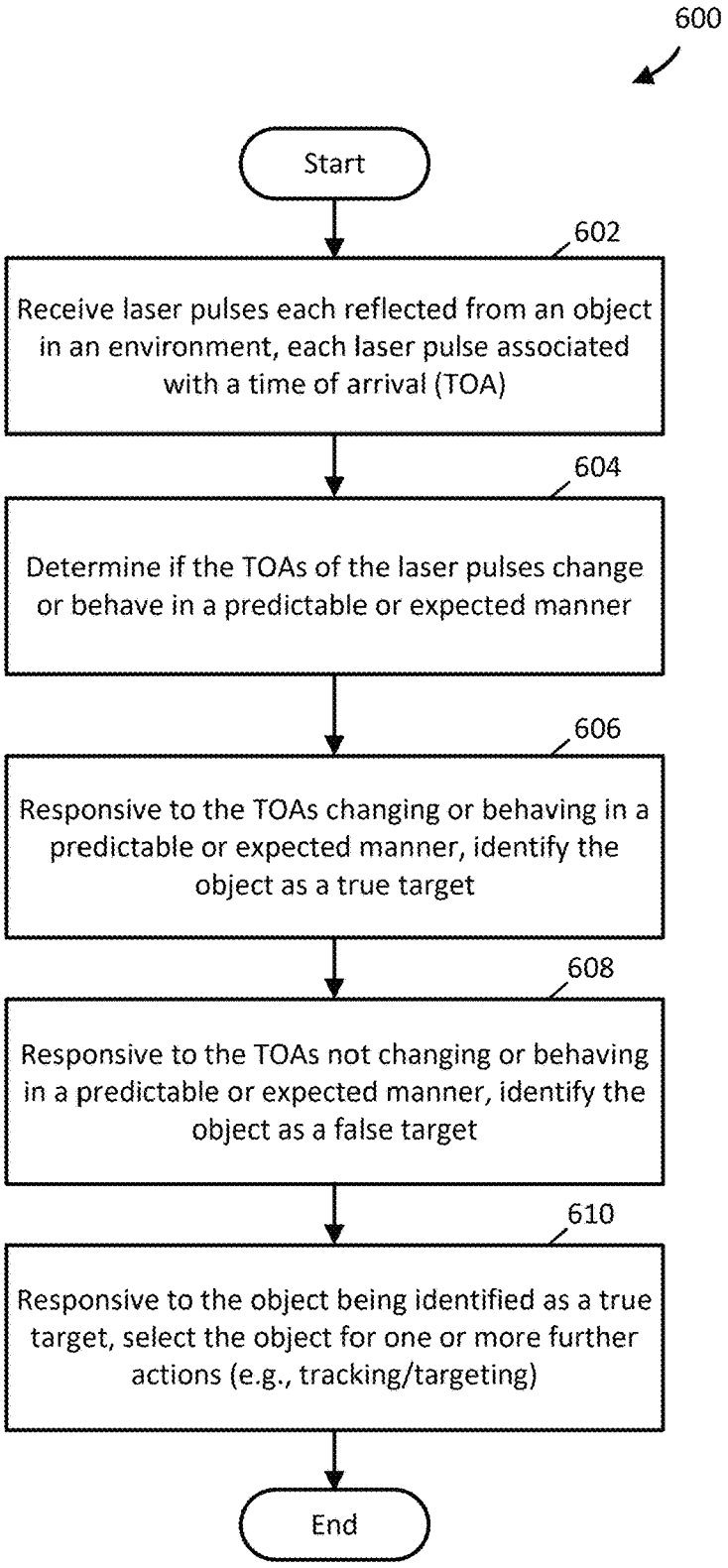
FIG. 6 a flow diagram illustrating details of a method to categorize authenticity of a laser seeker target, in accordance with an example of the present disclosure.

FIG. 6 a flow diagram illustrating details of a method 600 to categorize authenticity of a laser seeker target, in accordance with an example of the present disclosure. The method 600 can be carried out, for instance, by the system of FIG. 1, or other tracking and targeting systems. The method 600 of this example commences at 602 with receiving laser pulses each reflected from an object in an environment. Each laser pulse is associated with a time of arrival (TOA). The TOA may be related to the pulse's time-of-flight (TOF) from a laser pulse emitter (designator, illuminator) of the system to the object, and its return TOF to a receiver of the system (the total laser path distance, or TLPD), at the speed of light through the medium(s) through which the pulse is traveling.

The method 600 continues at 604 with determining if the TOAs of the laser pulses change or behave in a predictable or expected manner. Such determination may include, for example, the methodologies variously described above with respect to FIGS. 1 through 5E. More generally, the volatility of a given object's TOAs can be determined using any number of assessments that effectively qualify the TOAs as either being stable and/or otherwise behaving in an expected or predictable manner, or not. As described above, an object associated with TOAs having a high degree of volatility tends to be a false target, whereas an object associated with TOAs having a high degree of stability and/or predictability tends to be a true target. Any suitable characterization of volatility can be used.

Responsive to the TOAs changing or behaving in a predictable or expected manner, the method 600 continues at 606 with identifying the object as a true target. Also, responsive to the TOAs not changing or behaving in a predictable or expected manner, the method 600 continues at 608 with identifying the object as a false target. False targets can be ignored or otherwise dismissed from further processing, while true targets may be pursued further. For instance, in some examples, responsive to the object being identified as a true target, the method 600 may further include selecting the object for one or more further actions. The one or more further actions may include, for instance, targeting and/or tracking. In other examples, responsive to the object being identified as a true target, the method 600 may further include conveying target information about the object to one or more assets (e.g., weapon systems, reconnaissance systems, tracking systems), and/or issuing a command to engage object (e.g., via weapons system, or via communications system).

In some examples, the system for categorizing authenticity of a laser seeker target can include one or more non-transitory computer readable medium, which may include any suitable medium for storing digital information, such as a hard drive, a server, a flash memory, and/or random access memory (RAM), or a combination of memories. The one or more non-transitory computer readable medium may be read by one or more processors, which may execute code and/or instructions stored in a memory, such as instructions for any of the methods in the examples of FIGS. 4A-5E, and/or any other methods. In alternative embodiments, the functional components or modules described herein can be implemented with hardware, including gate-level logic such as a field-programmable gate array (FPGA), or alternatively, a purpose-built semiconductor such as an application-specific integrated circuit (ASIC). In some embodiments, the hardware may be modeled or developed using hardware description languages such as, for example Verilog or VHDL. Still other embodiments may be implemented with a microcontroller having a number of input/output ports for receiving and outputting data, and a number of embedded routines for carrying out the various functionalities described herein. It will be apparent that any suitable combination of hardware, software, and firmware can be used, and that other embodiments are not limited to any particular system architecture.

Some examples may be implemented, for example, using a machine-readable medium or article which may store an instruction or a set of instructions that, if executed by a machine, may cause the machine to perform a method and/or operations in accordance with an embodiment provided herein. Such a machine may include, for example, any suitable processing platform, computing platform, computing device, processing device, computing system, processing system, computer, process, or the like, and may be implemented using any suitable combination of hardware and/or software. The machine-readable medium or article may include, for example, any suitable type of memory unit, memory device, memory article, memory medium, storage device, storage article, storage medium, and/or storage unit, such as memory, removable or non-removable media, erasable or non-erasable media, writeable or rewriteable media, digital or analog media, hard disk, floppy disk, compact disk read only memory (CD-ROM), compact disk recordable (CD-R) memory, compact disk rewriteable (CD-RW) memory, optical disk, magnetic media, magneto-optical media, removable memory cards or disks, flash drives, various types of digital versatile disk (DVD), a tape, a cassette, or the like. The instructions may include any suitable type of code, such as source code, compiled code, interpreted code, executable code, static code, dynamic code, encrypted code, and the like, implemented using any suitable high level, low level, object oriented, visual, compiled, and/or interpreted programming language.

Unless specifically stated otherwise, it may be appreciated that terms such as "processing," "computing," "calculating," "determining," or the like refer to the action and/or process of a computer or computing system, or similar electronic computing device, that manipulates and/or transforms data represented as physical quantities (for example, electronic) within the registers and/or memory units of the computer system into other data similarly represented as physical quantities within the registers, memory units, or other such information storage transmission or displays of the computer system. The embodiments are not limited in this context.

The terms "circuit" or "circuitry," as used in any embodiment herein, are functional structures that include hardware, or a combination of hardware and software, and may comprise, for example, singly or in any combination, hardwired circuitry, programmable circuitry such as computer processors comprising one or more individual instruction processing cores, state machine circuitry, and/or gate level logic. The circuitry may include a processor and/or controller programmed or otherwise configured to execute one or more instructions to perform one or more operations described herein. The instructions may be embodied as, for example, an application, software, firmware, or one or more embedded routines configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads or parallel processes in a hierarchical fashion. Firmware may be embodied as code, instructions or instruction sets and/or data that are hard-coded (e.g., nonvolatile) in memory devices. The circuitry may, collectively or individually, be embodied as circuitry that forms part of a larger system, for example, an integrated circuit (IC), an application-specific integrated circuit (ASIC), a system-on-a-chip (SoC), computers, and other processor-based or functional systems. Other embodiments may be implemented as software executed by a programmable device. In any such hardware cases that include executable software, the terms "circuit" or "circuitry" are intended to include a combination of software and hardware such as a programmable device or a processor capable of executing the software. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Additional Examples

Example 1 is a method of categorizing authenticity of a laser seeker target. The method can comprise obtaining a set of measured pulse repetition intervals (PRIs) associated with acquired laser pulses. The method can further comprise categorizing a current volatility status of the laser seeker target. The current volatility status can indicate a respective volatility category of a set of volatility categories, and can be based on a volatility index and a volatility counter. The volatility index can indicate a variance of the set of measured PRIs. The volatility counter can indicate a number of the acquired laser pulses. The method can further comprise increasing a respective category counter of a set of category counters. The set of category counters can correspond to the set of volatility categories. The respective category counter can count occurrences of the respective volatility category. The method can further comprise categorizing the authenticity of the laser seeker target based on the set of category counters.

Example 2 includes the method of Example 1, further comprising: conveying target information to one or more assets, based on the categorized authenticity of the laser seeker target; and/or issuing a command to engage or not engage the laser seeker target, based on the categorized authenticity of the laser seeker target Example 3 includes the method of Example 1, further comprising obtaining an updated set of measured PRIs. The method can further comprise categorizing a second volatility status of the laser seeker target. The second volatility status can indicate a second volatility category of the set of volatility categories. The second volatility status can be based at least on an updated volatility index for the updated set of measured PRIs. The method can further comprise increasing a second category counter of the set of category counters. The second category counter can count occurrences of the second volatility category. The method can further comprise updating the categorization of the authenticity based on the increased second category counter.

Example 4 includes the method of any one of the previous Examples, further comprising decreasing the respective category counter.

Example 5 includes the method of any one of the previous Examples, wherein obtaining the set of measured PRIs comprises: receiving a set of measured pulse time of arrival (TOA) values; and computing a pulse repetition interval (PRI) as a difference between a first pulse TOA value and a second pulse TOA value of the set of measured pulse TOA values. The method may further include adjusting the first pulse TOA value and/or the PRI to correct for a seeker timer overflow.

Example 6 includes the method of Example 5, wherein the first pulse TOA value corresponds to a TOA of a laser pulse reflected by the laser seeker target and received by a laser pulse receiver; and receiving the set of measured pulse TOA values comprises receiving, from the laser pulse receiver, the first pulse TOA value.

Example 7 includes the method of any one of the previous Examples, wherein the volatility index indicates a variance of a rolling average of the set of measured PRIs.

Example 8 includes the method of any one of the previous Examples, wherein the current volatility status indicates a currently determined likelihood that the laser seeker target is authentic, and the authenticity indicates a cumulative likelihood that the laser seeker target is authentic.

Example 9 includes the method of any one of the previous Examples, wherein the set of measured PRIs comprises a time series of measured PRIs.

Example 10 includes the method of any one of the previous Examples, further comprising: responsive to the volatility index being less than a first threshold value and the volatility counter being greater than a second threshold value, categorizing the current volatility status as the respective volatility category, wherein the respective volatility category denotes a likely authentic target; responsive to the volatility index being substantially between the first threshold value and a third threshold value and the volatility counter being greater than the second threshold value, categorizing the current volatility status as the respective volatility category, wherein the third threshold value is greater than the first threshold value, and wherein the respective volatility category denotes a moderately likely authentic target; and responsive to the volatility index being at least the third threshold value or the volatility counter being at most the second threshold value, categorizing the current volatility status as the respective volatility category, wherein the respective volatility category denotes an unlikely authentic target.

Example 11 is a laser seeker system comprising at least a lens, a laser pulse detector, a laser pulse selector, and a selected pulse evaluator. The selected pulse evaluator can be configured to obtain a set of measured pulse repetition intervals (PRIs) associated with acquired laser pulses. The selected pulse evaluator can be further configured to categorize a current volatility status of the laser seeker target. The current volatility status can indicate a respective volatility category of a set of volatility categories, and can be based on a volatility index and a volatility counter. The volatility index can indicate a variance of the set of measured PRIs. The volatility counter can indicate a number of the acquired laser pulses. The selected pulse evaluator can be further configured to increase a respective category counter of a set of category counters. The set of category counters can correspond to the set of volatility categories. The respective category counter can count occurrences of the respective volatility category. The selected pulse evaluator can be further configured to categorize the authenticity of the laser seeker target based on the set of category counters; and convey target information to one or more assets (e.g., UAV, missile, or other platform or munition), based on the categorized authenticity of the laser seeker target.

Example 12 includes the laser seeker system of Example 11, wherein the selected pulse evaluator is further configured to: obtain an updated set of measured PRIs; categorize a second volatility status of the laser seeker target, wherein the second volatility status indicates a second volatility category of the set of volatility categories, and wherein the second volatility status is based at least on an updated volatility index for the updated set of measured PRIs; increase a second category counter of the set of category counters, wherein the second category counter counts occurrences of the second volatility category; and update the categorization of the authenticity based on the increased second category counter.

Example 13 includes the laser seeker system of Example 11 or Example 12, wherein to obtain the set of measured PRIs comprises: to receive, from the laser pulse detector and/or the laser pulse selector, a set of measured pulse time of arrival (TOA) values; and to compute a pulse repetition interval (PRI) as a difference between a first pulse TOA value and a second pulse TOA value of the set of measured pulse TOA values.

Example 14 includes the laser seeker system of any one of Examples 11 through 13, wherein the selected pulse evaluator is further configured to adjust the first pulse TOA value and/or the PRI to correct for a seeker timer overflow.

Example 15 includes the laser seeker system of any one of Examples 11 through 13, wherein the volatility index indicates a variance of a rolling average of the set of measured PRIs.

Example 16 includes the laser seeker system of any one of Examples 11 through 13, wherein to categorize the current volatility status further comprises: responsive to the volatility index being less than a first threshold value and the volatility counter being greater than a second threshold value, to categorize the current volatility status as the respective volatility category, wherein the respective volatility category denotes a likely authentic target; responsive to the volatility index being substantially between the first threshold value and a third threshold value and the volatility counter being greater than the second threshold value, to categorize the current volatility status as the respective volatility category, wherein the third threshold value is greater than the first threshold value, and wherein the respective volatility category denotes a moderately likely authentic target; and responsive to the volatility index being at least the third threshold value or the volatility counter being at most the second threshold value, to categorize the current volatility status as the respective volatility category, wherein the respective volatility category denotes an unlikely authentic target.

Example 17 is a non-transitory computer readable medium storing instructions that when executed by one or more processors cause a process to be carried out for categorizing authenticity of a laser seeker target. The process can comprise instructions to obtain a set of measured pulse repetition intervals (PRIs) associated with acquired laser pulses. The process can further comprise to categorize a current volatility status of the laser seeker target. The current volatility status can indicate a respective volatility category of a set of volatility categories, and can be based on a volatility index and a volatility counter. The volatility index can indicate a variance of the set of measured PRIs. The volatility counter can indicate a number of the acquired laser pulses. The process can further comprise to increase a respective category counter of a set of category counters. The set of category counters can correspond to the set of volatility categories. The respective category counter can count occurrences of the respective volatility category. The process can further comprise to categorize the authenticity of the laser seeker target based on the set of category counters, and conveying target information to one or more assets (e.g., UAV, missile, or other platform or munition), based on the categorized authenticity of the laser seeker target.

Example 18 includes the non-transitory computer readable medium of Example 17, wherein the process further comprises to: obtain an updated set of measured PRIs; categorize a second volatility status of the laser seeker target, wherein the second volatility status indicates a second volatility category of the set of volatility categories, and wherein the second volatility status is based at least on an updated volatility index for the updated set of measured PRIs; increase a second category counter of the set of category counters, wherein the second category counter counts occurrences of the second volatility category; and update the categorization of the authenticity based on the increased second category counter.

Example 19 includes the non-transitory computer readable medium of Example 17 or Example 18, wherein to obtain the set of measured PRIs comprises: to receive a set of measured pulse time of arrival (TOA) values; and to compute a pulse repetition interval (PRI) as a difference between a first pulse TOA value and a second pulse TOA value of the set of measured pulse TOA values.

Example 20 includes the non-transitory computer readable medium of any one of Examples 17 through 19, wherein the volatility index comprises a variance of a rolling average of the set of measured PRIs.

Example 21 is a laser seeker system configured to categorize authenticity of a laser seeker target. The laser seeker system can comprise a selected pulse evaluator configured to: obtain a set of measured pulse repetition intervals (PRIs) associated with laser pulses acquired by a laser pulse detector and/or a laser pulse selector; categorize a current volatility status of the laser seeker target, wherein the current volatility status indicates a respective volatility category of a set of volatility categories, and wherein the current volatility status is based on a volatility index and a volatility counter, the volatility index indicating a variance of the set of measured PRIs, and the volatility counter indicating a number of the acquired laser pulses; increase a respective category counter of a set of category counters, wherein the set of category counters corresponds to the set of volatility categories and the respective category counter counts occurrences of the respective volatility category; categorize the authenticity of the laser seeker target based on the set of category counters; and issue a command to engage the laser seeker target, based on the categorized authenticity of the laser seeker target.

Example 22 includes the laser seeker system of Example 21, wherein the selected pulse evaluator is further configured to: obtain an updated set of measured PRIs; categorize a second volatility status of the laser seeker target, wherein the second volatility status indicates a second volatility category of the set of volatility categories, and wherein the second volatility status is based at least on an updated volatility index for the updated set of measured PRIs; increase a second category counter of the set of category counters, wherein the second category counter counts occurrences of the second volatility category; and update the categorization of the authenticity based on the increased second category counter.

Example 23 includes the laser seeker system of Example 21 or Example 22, wherein to obtain the set of measured PRIs comprises: to receive, from the laser pulse detector and/or the laser pulse selector, a set of measured pulse time of arrival (TOA) values; and to compute a pulse repetition interval (PRI) as a difference between a first pulse TOA value and a second pulse TOA value of the set of measured pulse TOA values.

Example 24 includes the laser seeker system of Example 23, wherein the selected pulse evaluator is further configured to adjust the first pulse TOA value and/or the PRI to correct for a seeker timer overflow.

Example 25 includes the laser seeker system of any one of Examples 21 through 24, wherein the volatility index indicates a variance of a rolling average of the set of measured PRIs.

Example 26 includes the laser seeker system of any one of Examples 21 through 25, wherein to categorize the current volatility status further comprises: responsive to the volatility index being less than a first threshold value and the volatility counter being greater than a second threshold value, to categorize the current volatility status as the respective volatility category, wherein the respective volatility category denotes a likely authentic target; responsive to the volatility index being substantially between the first threshold value and a third threshold value and the volatility counter being greater than the second threshold value, to categorize the current volatility status as the respective volatility category, wherein the third threshold value is greater than the first threshold value, and wherein the respective volatility category denotes a moderately likely authentic target; and responsive to the volatility index being at least the third threshold value or the volatility counter being at most the second threshold value, to categorize the current volatility status as the respective volatility category, wherein the respective volatility category denotes an unlikely authentic target.

Example 27 includes the laser seeker system of any one of Examples 21 through 26, wherein the selected pulse evaluator comprises: one or more processors; and one or more memories encoded with instructions that when executed by the one or more processors cause functionality of the selected pulse evaluator to be carried out.

Example 28 includes the laser seeker system of any one of Examples 21 through 27, further comprising an entrance aperture, the laser pulse detector, and the laser pulse selector.

Example 29 includes the laser seeker system of Example 28, further comprising an entrance aperture.

Example 30 includes the laser seeker system of Example 29, further comprising a splitter coupled between the entrance aperture and the laser pulse detector.

Example 31 is a method to categorize authenticity of a laser seeker target. The method includes receiving laser pulses each reflected from an object in an environment. Each laser pulse is associated with a time of arrival (TOA). The method continues with determining if the TOAs of the laser pulses change or behave in a predictable or expected manner. Responsive to the TOAs changing or behaving in a predictable or expected manner, the method continues with identifying the object as a true target. Responsive to the TOAs not changing or behaving in a predictable or expected manner, the method continues with identifying the object as a false target.

Example 32 includes the method of Example 31, wherein responsive to the object being identified as a true target, the method further includes selecting the object for one or more further actions.

Example 33 includes the method of Example 32, wherein the one or more further actions may include, for instance, targeting and/or tracking.

Example 34 includes the method of any one of Examples 31 through 33, wherein responsive to the object being identified as a true target, the method further includes conveying target information about the object to one or more assets, and/or issuing a command to engage object.

Example 35 includes a non-transitory computer readable medium storing instructions that when executed by one or more processors cause a process to be carried out for categorizing authenticity of a laser seeker target. The process may be, for instance, the method of any one of Examples 31 through 34.

Example 36 is a system that includes the non-transitory computer readable medium of Example 35. The system may be, for instance, a tracking and/or targeting system or sub-system of a weapon system.

The foregoing description of the embodiments of the disclosure has been presented for the purposes of illustration and description. It is not intended to be exhaustive or to limit the disclosure to the precise forms disclosed. Many modifications and variations are possible in light of this disclosure. It is intended that the scope of the disclosure be limited not by this detailed description, but rather by the claims appended hereto.

What is claimed is:

1. A method of categorizing authenticity of a laser seeker target, comprising:

obtaining a set of measured pulse repetition intervals (PRIs) associated with acquired laser pulses;

categorizing a current volatility status of the laser seeker target, wherein the current volatility status indicates a respective volatility category of a set of volatility categories, and wherein the current volatility status is based on a volatility index and a volatility counter, the volatility index indicating a variance of the set of measured PRIs, and the volatility counter indicating a number of the acquired laser pulses;

increasing a respective category counter of a set of category counters, wherein the set of category counters corresponds to the set of volatility categories and the respective category counter counts occurrences of the respective volatility category; and categorizing the authenticity of the laser seeker target based on the set of category counters.

2. The method of claim 1, further comprising:

conveying target information to one or more assets, based on the categorized authenticity of the laser seeker target; and/or issuing a command to engage or not engage the laser seeker target, based on the categorized authenticity of the laser seeker target.

3. The method of claim 1, further comprising:

obtaining an updated set of measured PRIs;

categorizing a second volatility status of the laser seeker target, wherein the second volatility status indicates a second volatility category of the set of volatility categories, and wherein the second volatility status is based at least on an updated volatility index for the updated set of measured PRIs;

increasing a second category counter of the set of category counters, wherein the second category counter counts occurrences of the second volatility category; and updating the categorization of the authenticity based on the increased second category counter.

4. The method of claim 3, further comprising decreasing the respective category counter.

5. The method of claim 1, wherein obtaining the set of measured PRIs comprises:

receiving a set of measured pulse time of arrival (TOA) values;

computing a pulse repetition interval (PRI) as a difference between a first pulse TOA value and a second pulse TOA value of the set of measured pulse TOA values; and adjusting the first pulse TOA value and/or the PRI to correct for a seeker timer overflow.

6. The method of claim 5, wherein:

the first pulse TOA value corresponds to a TOA of a laser pulse reflected by the laser seeker target and received by a laser pulse receiver; and receiving the set of measured pulse TOA values comprises receiving, from the laser pulse receiver, the first pulse TOA value.

7. The method of claim 1, wherein the volatility index indicates a variance of a rolling average of the set of measured PRIs.

8. The method of claim 1, wherein the current volatility status indicates a currently determined likelihood that the laser seeker target is authentic, and the authenticity indicates a cumulative likelihood that the laser seeker target is authentic.

9. The method of claim 1, wherein the set of measured PRIs comprises a time series of measured PRIs.

10. The method of claim 1, wherein categorizing the current volatility status comprises:

responsive to the volatility index being less than a first threshold value and the volatility counter being greater than a second threshold value, categorizing the current volatility status as the respective volatility category, wherein the respective volatility category denotes a likely authentic target;

responsive to the volatility index being between the first threshold value and a third threshold value and the volatility counter being greater than the second threshold value, categorizing the current volatility status as the respective volatility category, wherein the third threshold value is greater than the first threshold value, and wherein the respective volatility category denotes a moderately likely authentic target; and responsive to the volatility index being at least the third threshold value or the volatility counter being at most the second threshold value, categorizing the current volatility status as the respective volatility category, wherein the respective volatility category denotes an unlikely authentic target.

11. A non-transitory computer readable medium storing instructions that when executed by one or more processors cause a process to be carried out for categorizing authenticity of a laser seeker target, the process comprising:

obtain a set of measured pulse repetition intervals (PRIs) associated with acquired laser pulses;

categorize a current volatility status of the laser seeker target, wherein the current volatility status indicates a respective volatility category of a set of volatility categories, and wherein the current volatility status is based on a volatility index and a volatility counter, the volatility index indicating a variance of the set of measured PRIs, and the volatility counter indicating a number of the acquired laser pulses;

increase a respective category counter of a set of category counters, wherein the set of category counters corresponds to the set of volatility categories and the respective category counter counts occurrences of the respective volatility category;

categorize the authenticity of the laser seeker target based on the set of category counters; and convey target information to one or more assets, based on the categorized authenticity of the laser seeker target.

12. The non-transitory computer readable medium of claim 11, the process further comprising to:

obtain an updated set of measured PRIs;

categorize a second volatility status of the laser seeker target, wherein the second volatility status indicates a second volatility category of the set of volatility categories, and wherein the second volatility status is based at least on an updated volatility index for the updated set of measured PRIS;

increase a second category counter of the set of category counters, wherein the second category counter counts occurrences of the second volatility category; and update the categorization of the authenticity based on the increased second category counter.

13. The non-transitory computer readable medium of claim 11, wherein to obtain the set of measured PRIs comprises:

to receive a set of measured pulse time of arrival (TOA) values; and to compute a pulse repetition interval (PRI) as a difference between a first pulse TOA value and a second pulse TOA value of the set of measured pulse TOA values.

14. The non-transitory computer readable medium of claim 11, wherein the volatility index comprises a variance of a rolling average of the set of measured PRIs.

15. A laser seeker system configured to categorize authenticity of a laser seeker target, the laser seeker system comprising:

a selected pulse evaluator configured to:

obtain a set of measured pulse repetition intervals (PRIs) associated with laser pulses acquired by a laser pulse detector and/or a laser pulse selector;

categorize a current volatility status of the laser seeker target, wherein the current volatility status indicates a respective volatility category of a set of volatility categories, and wherein the current volatility status is based on a volatility index and a volatility counter, the volatility index indicating a variance of the set of measured PRIs, and the volatility counter indicating a number of the acquired laser pulses;

increase a respective category counter of a set of category counters, wherein the set of category counters corresponds to the set of volatility categories and the respective category counter counts occurrences of the respective volatility category;

categorize the authenticity of the laser seeker target based on the set of category counters; and issue a command to engage the laser seeker target, based on the categorized authenticity of the laser seeker target.

16. The laser seeker system of claim 15, wherein the selected pulse evaluator is further configured to:

obtain an updated set of measured PRIs;

categorize a second volatility status of the laser seeker target, wherein the second volatility status indicates a second volatility category of the set of volatility categories, and wherein the second volatility status is based at least on an updated volatility index for the updated set of measured PRIS;

increase a second category counter of the set of category counters, wherein the second category counter counts occurrences of the second volatility category; and update the categorization of the authenticity based on the increased second category counter.

17. The laser seeker system of claim 15, wherein to obtain the set of measured PRIs comprises:

to receive, from the laser pulse detector and/or the laser pulse selector, a set of measured pulse time of arrival (TOA) values; and to compute a pulse repetition interval (PRI) as a difference between a first pulse TOA value and a second pulse TOA value of the set of measured pulse TOA values.

18. The laser seeker system of claim 17, wherein the selected pulse evaluator is further configured to adjust the first pulse TOA value and/or the PRI to correct for a seeker timer overflow.

19. The laser seeker system of claim 15, wherein the volatility index indicates a variance of a rolling average of the set of measured PRIs.

20. The laser seeker system of claim 15, wherein to categorize the current volatility status further comprises:

responsive to the volatility index being less than a first threshold value and the volatility counter being greater than a second threshold value, to categorize the current volatility status as the respective volatility category, wherein the respective volatility category denotes a likely authentic target;

responsive to the volatility index being between the first threshold value and a third threshold value and the volatility counter being greater than the second threshold value, to categorize the current volatility status as the respective volatility category, wherein the third threshold value is greater than the first threshold value, and wherein the respective volatility category denotes a moderately likely authentic target; and responsive to the volatility index being at least the third threshold value or the volatility counter being at most the second threshold value, to categorize the current volatility status as the respective volatility category, wherein the respective volatility category denotes an unlikely authentic target.

21. The laser seeker system of claim 15, wherein the selected pulse evaluator comprises: one or more processors; and one or more memories encoded with instructions that when executed by the one or more processors cause functionality of the selected pulse evaluator to be carried out.

22. The laser seeker system of claim 15, further comprising an entrance aperture, the laser pulse detector, and the laser pulse selector.

* * * * *